US009242283B2

(12) United States Patent
Imanari et al.

(10) Patent No.: US 9,242,283 B2
(45) Date of Patent: Jan. 26, 2016

(54) CONTROL APPARATUS OF ROLLING MILL

(75) Inventors: Hiroyuki Imanari, Tokyo (JP); Shigeo Kawamura, Tokyo (JP); Kazuyuki Maruyama, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 346 days.

(21) Appl. No.: 13/880,073

(22) PCT Filed: Nov. 22, 2010

(86) PCT No.: PCT/JP2010/070804

§ 371 (c)(1),
(2), (4) Date: Apr. 18, 2013

(87) PCT Pub. No.: WO2012/070099

PCT Pub. Date: May 31, 2012

(65) Prior Publication Data

US 2013/0213103 A1 Aug. 22, 2013

(51) Int. Cl.
*B21B 37/18* (2006.01)
*B21B 37/66* (2006.01)
(Continued)

(52) U.S. Cl.
CPC ..... *B21B 37/18* (2013.01); *B21B 37/66* (2013.01); *B21B 37/16* (2013.01); *B21B 37/62* (2013.01); *B21B 2265/12* (2013.01); *B21B 2271/02* (2013.01)

(58) Field of Classification Search
CPC ..... B21B 37/16; B21B 37/18; B21B 37/58; B21B 37/66
See application file for complete search history.

(56) References Cited

U.S. PATENT DOCUMENTS 4,126,027 A * 11/1978 Smith et al. ..... 72/13.4
6,263,714 B1 * 7/2001 Johnson et al. ..... 72/9.2

FOREIGN PATENT DOCUMENTS

JP 7 185626 7/1995
JP 11-285717 A 10/1999
JP 2002 282917 10/2002
(Continued)

OTHER PUBLICATIONS

International Search Report Issued Mar. 1, 2011 in PCT/JP10/70804 Filed Nov. 22, 2010.
(Continued)

*Primary Examiner* — Teresa M Ekiert
(74) *Attorney, Agent, or Firm* — Oblon, McClelland, Maier & Neustadt, L.L.P.

(57) ABSTRACT

A control apparatus of a rolling mill includes a load top/bottom distributor distributing loads as top and bottom side loads, a load top/bottom variation identification mechanism identifying load variation components occurring in connection with a rotational position of rolls from the top and bottom side loads, and top/bottom identified load variation storage storing, for each rotational position of rolls, top and bottom side variation components of the load in a kiss-roll condition identified by the load top/bottom variation identification mechanism. A manipulated variable computer computes a roll gap instruction value based on the top and bottom side variation components of the rolling load identified by the load top/bottom variation identification mechanism, and the top side variation component and the bottom side variation component of the load in a kiss-roll condition stored in the top/bottom identified load variation storage.

13 Claims, 13 Drawing Sheets

No. 10:LOAD TOP/BOTTOM DISTRIBUTION MEANS
No. 11:LOAD TOP/BOTTOM VARIATION IDENTIFICATION MEANS
No. 12:TOP/BOTTOM IDENTIFIED LOAD VARIATION STORAGE MEANS
No. 13:MANIPULATED VARIABLE COMPUTATION MEANS
No. 14:ROLL GAP MANIPULATION MEANS

(51) Int. Cl.
*B21B 37/16* (2006.01)
*B21B 37/62* (2006.01)

(56) References Cited

FOREIGN PATENT DOCUMENTS

| | | |
|---|---|---|
| WO | 2006 123394 | 11/2006 |
| WO | 2008 090596 | 7/2008 |
| WO | 2011 132273 | 10/2011 |

OTHER PUBLICATIONS

Written Opinion issued Mar. 1, 2011 in PCT/JP2010/070804 filed on Nov. 22, 2010 (English translation only).

Extended European Search Report issued Jun. 23, 2015 in Patent Application No. 10860051.0.

* cited by examiner

No. 10:LOAD TOP/BOTTOM DISTRIBUTION MEANS
No. 11:LOAD TOP/BOTTOM VARIATION IDENTIFICATION MEANS
No. 12:TOP/BOTTOM IDENTIFIED LOAD VARIATION STORAGE MEANS
No. 13:MANIPULATED VARIABLE COMPUTATION MEANS
No. 14:ROLL GAP MANIPULATION MEANS

No. 10:LOAD TOP/BOTTOM DISTRIBUTION MEANS
No. 27:ROLL GAP TOP/BOTTOM VARIATION IDENTIFICATION MEANS
No. 28:TOP/BOTTOM IDENTIFIED ROLL GAP VARIATION STORAGE MEANS
No. 29:MANIPULATED VARIABLE COMPUTATION MEANS
No. 14:ROLL GAP MANIPULATION MEANS

CONTROL APPARATUS OF ROLLING MILL

TECHNICAL FIELD

The present invention relates to a control apparatus for reducing periodic disturbances, for example, load variations which periodically occur with respect to the rotation position of rolls and the like and gauge variations which occur as a result of the load variations, in the gauge control during the rolling of a metal material.

BACKGROUND ART

One of quality control methods in sheet rolling and plate rolling is automatic gauge control (AGC) which involves controlling the plate thickness of a rolled material in the middle part of the width direction. Examples of concrete control methods include monitor AGC which involves feeding back measured values of a plate thickness gauge installed on the exit side of a rolling mill, gauge meter AGC (GM-AGC) which involves using gauge meter plate thicknesses estimated from rolling loads and roll gaps (the clearance between top and bottom work rolls), and mill modulus control (MMC) which involves using rolling loads.

For example, in the case of hot rolling, temperature variations of rolled materials can be mentioned as disturbances which hinder an improvement in thickness accuracy. As disturbances common to hot rolling and cold rolling, other kinds of control items, for example, tension variations due to the deterioration of tension control, changes in speed or roll gap by an operator's manual intervention, roll eccentricity caused by accuracy deficiencies of the roll structure or roll grinding can be mentioned.

Among these disturbances, the main cause of the above-described roll eccentricity is that when key grooves of support rolls having oil bearings are subjected to a rolling load of as large as several hundreds of tons to two to three thousands of tons, shafts move up and down (undergo shaft oscillation). When roll eccentricity occurs, variations in roll gap occur correspondingly to the rotation of rolls.

Even in the case of rolls not provided with key grooves, periodic roll gap variations dependent on the rotation of the rolls occur caused by asymmetry during roll grinding and uneven thermal expansion, for example.

A rolling mill is provided with a roll gap detector for detecting roll gaps, and a device which controls roll gaps controls a screw-down device by feeding back detected values of the roll gap detector so that the roll gap obtains a given value (a set value). However, disturbances dependent on the shaft oscillation of rolls, such as roll eccentricity, cannot be detected by a roll gap detector. That is, the effect of the shaft oscillation of rolls does not manifest itself in detected values of the roll gap detector. For this reason, it is impossible to perform such control as to suppress the disturbances dependent on the shaft oscillation of rolls even when a roll gap detector is used. However, because in actuality, the disturbances dependent on the shaft oscillation of rolls change roll gaps, the effect of the shaft oscillation of rolls manifests itself in rolling loads. Therefore, the disturbances dependent on the shaft oscillation of rolls provides a great factor responsible for hindering an improvement in thickness accuracy in GM-AGC, MMC and the like which involve performing gauge control using rolling loads.

In order to reduce disturbances which periodically occur (hereinafter, referred to as "periodic disturbances") such as roll eccentricity, roll eccentricity control has hitherto been performed. Some examples related to roll eccentricity control are described below.

In the following descriptions (including the description of the present invention), the same concept can be used in the case of what is called a 2Hi mill, which is composed of only two of the top and bottom work rolls, the case of what is called a 4Hi mill, which is composed of a total of four rolls: two of the top and bottom work rolls and two of the top and bottom support rolls, and the case of what is called a 6Hi mill, which is composed of a total of six rolls: two of the top and bottom work rolls, two of the top and bottom intermediate rolls, and two of the top and bottom support rolls, and even in the case of a mill composed of not less than six rolls. For this reason, in the following, the terms "WR" for work roll and "BUR" for back up roll, which are rolls other than work rolls, are used.

(A) Roll Eccentricity Control 1

Before the rolling of a rolled material, the top and bottom work rolls are brought into contact with each other, and the rolls are rotated, with a given load applied to the rolls (in a kiss-roll condition), and a load in the kiss-roll condition is detected. Then, roll eccentricity frequencies are analyzed by performing the fast Fourier transformation and the like of the detected load in the kiss-roll condition. During rolling, it is assumed that roll eccentricity at the analyzed frequency occur, and a manipulated variable of roll gap is outputted in such a manner as to reduce the effect of the above-described roll eccentricity without performing feedback control using loading loads.

(B) Roll Eccentricity Control 2

Plate thickness variations are measured using a plate thickness gauge installed on the exit side of a rolling mill. Then, a thickness deviation is computed linking at which rotation positions of rolls, values measured by the plate thickness gauge have been obtained during rolling. The control apparatus manipulates roll gaps according to the computed thickness deviation and reduces the thickness variations due to roll eccentricity.

(C) Roll Eccentricity Control 3

During rolling, rolling loads are detected and roll eccentricity components are extracted from the rolling loads. Then, the extracted roll eccentricity components are converted to roll gap signals, and roll gaps are manipulated so that the rolling load variations due to the roll eccentricity are reduced (refer to Patent Literature 1 and Patent Literature 2).

CITATION LIST

Patent Literature

Patent Literature 1: Japanese Patent Laid-Open No. 2002-282917

Patent Literature 2: International Patent Publication No. WO2008/090596

SUMMARY OF INVENTION

Technical Problem

Because problems in the above-described roll eccentricity controls 1 and 2 as well as problems in roll eccentricity control 3 described in Patent Literature 1 are described in Patent Literature 2, descriptions of these problems are omitted here.

As described in Patent Literature 2, in the case where the diameters of top and bottom buck up rolls are different, a phenomenon what is called beat or waviness occurs and deteriorated control occurs.

In the roll eccentricity control described in Patent Literature 2, although a roll gap manipulation is performed by appropriately extracting roll eccentricity components from loads during rolling, there occurs the problem that high-accuracy gauge control cannot be performed for the extreme leading end of a rolled material.

For example, in the gauge control of an extreme leading end of a rolled material, Patent Literature 2 describes using a value obtained during the rolling of material immediately before the rolling in question (in particular, refer to paragraph 0069). However, this method has the problem that in the case where after the detection of the value, a shift occurs in roll position due to the slip of back up rolls and work rolls, it is impossible to carry out accurate gauge control.

Patent Literature 2 also describes a method in which means for extracting load variations in a kiss-roll condition is separately provided, whereby roll eccentricity components are extracted from the load in a kiss-roll condition and the components are used in the gauge control for an extreme leading end of a rolled material (in particular, refer to paragraphs 0070 and 0037). However, also in this case, there is a problem that, because of a difference between the extraction method in a kiss-roll condition and the extraction method during rolling, high-accuracy gauge control cannot be carried out, and furthermore, the configuration becomes complex.

This invention was made to solve the problems described above, and an object of the invention is to provide a control apparatus of a rolling mill which enables periodic disturbances caused by roll eccentricity and the like to be appropriately suppressed in the gauge control during the rolling of a metal material, and furthermore, which enables high-accuracy gauge control to be realized also in the rolling of an extreme leading end of a rolled material.

Solution to Problems

A control apparatus of a rolling mill of the invention is a control apparatus for reducing periodic disturbances which are caused mainly by roll eccentricity, in gauge control during rolling of a metal material. The control apparatus comprises a load detecting device for detecting a load in a kiss-roll condition and a rolling load, load top/bottom distribution means which distributes loads detected by the load detecting device as a top side load and a bottom side load at a prescribed ratio, load top/bottom variation identification means which identifies load variation components occurring in connection with a rotational position of rolls from the top side load and the bottom side load which are distributed by the load top/bottom distribution means, top/bottom identified load variation storage means which stores, for each rotational position of rolls, a top side variation component and a bottom side variation component of the load in a kiss-roll condition which are identified by the load top/bottom variation identification means, manipulated variable computation means which computes a roll gap instruction value responding to each rotational position of rolls on the basis of the top side variation component and the bottom side variation component of the rolling load which are identified by the load top/bottom variation identification means, as well as the top side variation component and the bottom side variation component of the load in a kiss-roll condition which are stored in the top/bottom identified load variation storage means, in such a manner as to reduce plate thickness variations of a metal material which is being rolled, and roll gap manipulation means which manipulates a roll gap on the basis of the roll gap instruction value computed by the manipulated variable computation means.

Also, a control apparatus of a rolling mill of the invention is a control apparatus which for reducing periodic disturbances which are caused mainly by roll eccentricity, in gauge control during rolling of a metal material. The control apparatus comprises a load detecting device for detecting a load in a kiss-roll condition and a rolling load, load top/bottom distribution means which distributes loads detected by the load detecting device as a top side load and a bottom side load at a prescribed ratio, roll gap top/bottom variation identification means which identifies roll gap variation components occurring in connection with a rotational position of rolls from the top side load and the bottom side load which are distributed by the load top/bottom distribution means, top/bottom identified roll gap variation storage means which stores, for each rotational position of rolls, a top side variation component and a bottom side variation component of a roll gap which are identified by the roll gap top/bottom variation identification means in a kiss-roll condition, manipulated variable computation means which computes a roll gap instruction value responding to each rotational position of rolls on the basis of the top side variation component and the bottom side variation component of the roll gap which are identified by the roll gap top/bottom variation identification means during the rolling of the metal material, as well as the top side variation component and the bottom side variation component of the roll gap which are stored in the top/bottom identified roll gap variation storage means, in such a manner as to reduce plate thickness variations of the metal material which is being rolled, and roll gap manipulation means which manipulates a roll gap on the basis of the roll gap instruction value computed by the manipulated variable computation means.

Advantageous Effects of Invention

According to the control apparatus of a rolling mill of this invention, it becomes possible to appropriately suppress periodic disturbances caused by roll eccentricity and the like in the gauge control during the rolling of a metal material, and furthermore, to realize high-accuracy gauge control also in the rolling of an extreme leading end of a rolled material.

DESCRIPTION OF EMBODIMENTS

The present invention will be described in more detail with reference to the accompanying drawings. Incidentally, in each of the drawings, like numerals refer to like or corresponding parts and redundant descriptions of these parts are appropriately simplified or omitted.

First Embodiment

Figure 1:
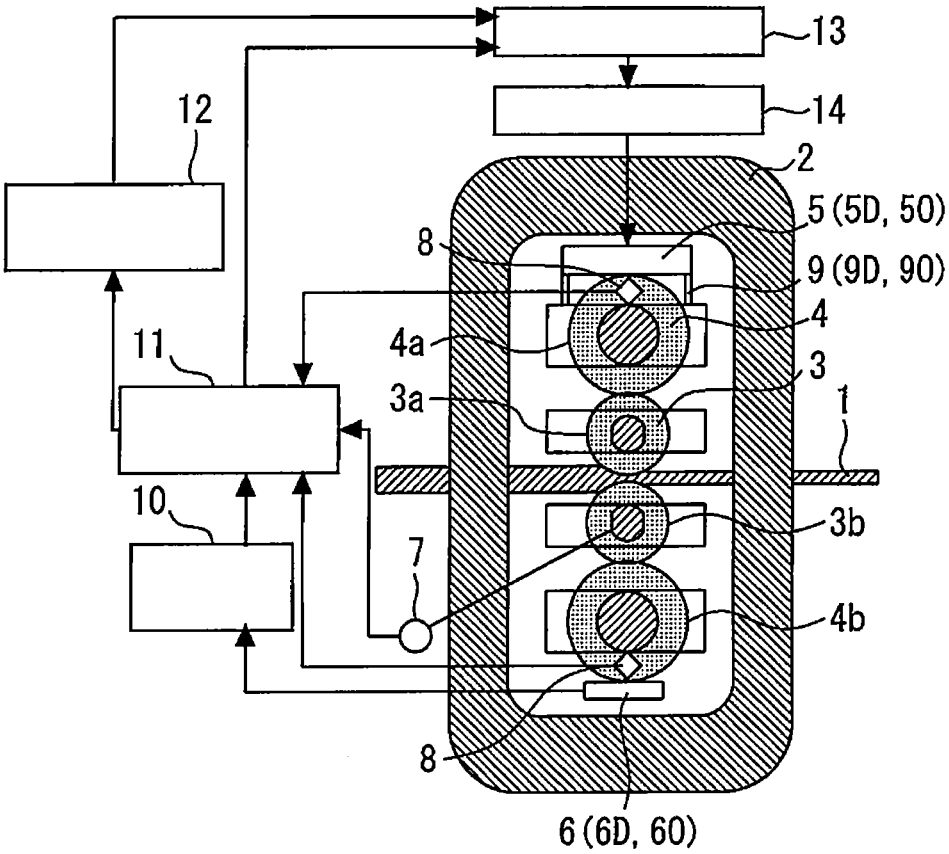
FIG. 1 is a diagram showing the general configuration of a control apparatus of a rolling mill in a first embodiment according to the present invention.

FIG. 1 is a diagram showing the general configuration of a control apparatus of a rolling mill in a first embodiment according to the present invention.

In FIG. 1, reference numeral 1 denotes a rolled material, which is made of a metal material, reference numeral 2 denotes a housing of a rolling mill, reference numeral 3 denotes a work roll, and reference numeral 4 denotes a back up roll. The rolled material 1 is rolled by the work rolls 3 whose roll gaps and speeds are appropriately adjusted so that a desired thickness is obtained on the exit side of the rolling mill.

In FIG. 1, a 4Hi mill is shown as an example of a rolling mill. That is, in this embodiment, the work roll 3 includes a top work roll 3*a* and a bottom work roll 3*b*. The back up roll 4 includes a top back up roll 4*a* and a bottom back up roll 4*b*. The work roll 3 is configured in such a manner as to be supported by the back up roll 4 so that deflection in the roll width direction becomes small. Specifically, the top work roll 3*a* is supported by the top back up roll 4*a* from above, and the bottom work roll 3*b* is supported by the bottom back up roll 4*b* from below. The back up roll 4 is supported by the housing 2, and has a prescribed structure capable of sufficiently withstanding the load during the rolling of the rolled material 1.

Reference numeral 5 denotes a screw-down device. The gap between the top work roll 3*a* and the bottom work roll 3*b*, i.e., the roll gap is adjusted by this screw-down device 5. Although there are two types of screw-down devices 5: a screw-down device by motor control (called a motor-driven screw-down device) and a screw-down device by hydraulic control (called a hydraulic screw-down device), high-speed responses can easily be obtained in a hydraulic screw-down device. Because high-speed responses are necessary for controlling short-period disturbances such as roll eccentricity, a hydraulic screw-down device is generally adopted for rolling mills.

For the sake of convenience, a rolling mill is divided into what is called a drive side where motors and drive units are disposed and an operator side where an operating room is disposed, the side opposite to the drive side, based on the rolling line as a boundary. In the following description, when it is necessary to clearly make a discrimination between the drive side and the operator side, the suffix D or DR is used to express the drive side and the suffix O or OP is used to express the operator side.

The screw-down device 5 is installed on both the drive side and the operator side. That is, a screw-down device 5D is installed on the drive side of the rolling mill and a screw-down device 5O is installed on the operator side. The roll gap is adjusted using both screw-down devices 5D and 5O.

Reference numeral 6 denotes a load detecting device for detecting loads in a rolling mill. As with the screw-down device 5, the load detecting device 6 is installed on the drive side and the operator side. That is, a load detecting device 6D is installed on the drive side of the rolling mill and a load detecting device 6O is installed on the operator side. There are various methods as load detection methods. For example, the load detecting device 6 detects load directly by a load cell embedded between the housing 2 and the screw-down device 5. In addition, the load detecting device 6 indirectly calculates loads on the basis of pressures detected in a hydraulic screw-down device.

"Load" includes both a rolling load and a load in a kiss-roll condition. A rolling load is a load equivalent to the rolling reaction force from the rolled material 1 while the rolled material 1 is being rolled. A load in a kiss-roll condition is a load generated in what is called a kiss-roll condition in which the top work roll 3*a* and the bottom work roll 3*b* are brought into contact with each other when there is no rolled material 1. In the following, in the case where it is unnecessary to make a clear discrimination between a load in a kiss-roll condition and a rolling load, "load" is simply used.

Reference numeral 7 denotes a roll rotation speed detector for detecting the rotation speed of the work roll 3 (or the back up roll 4). The roll rotation speed detector 7 is provided in the work roll 3 or a shaft of an electric motor (not shown) which drives this work roll 3. The configuration may be such that as one function of the roll rotation speed detector 7, pulses responding to the rotational angle of the work roll 3 are outputted. With this configuration, it becomes possible to detect the rotational angle of the work roll 3 by use of the roll rotation speed detector 7. Furthermore, if the ratio of the diameter of the work roll 3 to the diameter of the back up roll 4 is known, on the basis of the rotation speed and rotational angle of the work roll 3 detected by the roll rotation speed detector 7, it also becomes possible to easily find (compute) the rotation speed and rotational angle of the back up roll 4 in the case where there is no slip between the work roll 3 and the back up roll 4.

Reference numeral 8 denotes a roll reference position detector which detects a prescribed reference position each time the back up roll 4 rotates one turn. The roll reference position detector 8 is provided with, for example, a proximity sensor, and detects an object to be detected (i.e., the reference position) provided in the back up roll 4 each time the back up roll 4 rotates one turn. The roll reference position detector 8 may have any configuration so long as it has the detection function for reference position. For example, by using a pulse generator, the roll reference position detector 8 may detect the rotational angle itself of the back up roll 4 by taking out a pulse dependent on the rotational angle of the back up roll 4.

FIG. 1 shows the case where the roll reference position detector 8 is provided on both the top back up roll 4*a* and the bottom back up roll 4*b*. If the above-described function can be realized, the roll reference position detector 8 may be attached to only either the top back up roll 4*a* or the bottom back up roll 4*b*. Even when the roll reference position detector 8 is not provided as a discrete device, if the ratio of the diameter of the work roll 3 to the diameter of the back up roll 4 is known, it is also possible to find, by computation, the rotational angle of the back up roll 4 from the rotational angle of the work roll 3.

[Expression 1]

$$\theta_B = \frac{D_W}{D_B}\theta_W \quad (1)$$

where, $\theta_B$: Rotational angle of back up roll [rad]

$\theta_W$: Rotational angle of work roll [rad]

$D_B$: Diameter of back up roll [mm]

$D_W$: Diameter of work roll [mm]

In the above expression and the following, the symbol θ refers to an angle, the affix W refers to the work roll 3, and the suffix B refers to the back up roll 4.

Reference numeral 9 denotes a roll gap detector for detecting the roll gap. The roll gap detector 9 is provided, for example, between the back up roll 4 and the screw-down device 5, and indirectly detects the roll gap. As with the screw-down device 5, the roll gap detector 9 is installed on both the drive side and the operator side. That is, a roll gap detector 9D is installed on the drive side of the rolling mill, and a roll gap detector 90 is installed on the operator side.

Reference numeral 10 denotes load top/bottom distribution mean's, reference numeral 11 denotes load top/bottom variation identification means, reference numeral 12 denotes top/bottom identified load variation storage means, reference numeral 13 denotes manipulated variable computation means, and reference numeral 14 denotes roll gap manipulation means. Hereinafter, also referring to FIGS. 2 to 8, a concrete description will be given of the configuration and function of each of the means 10 to 14.

Figure 2:
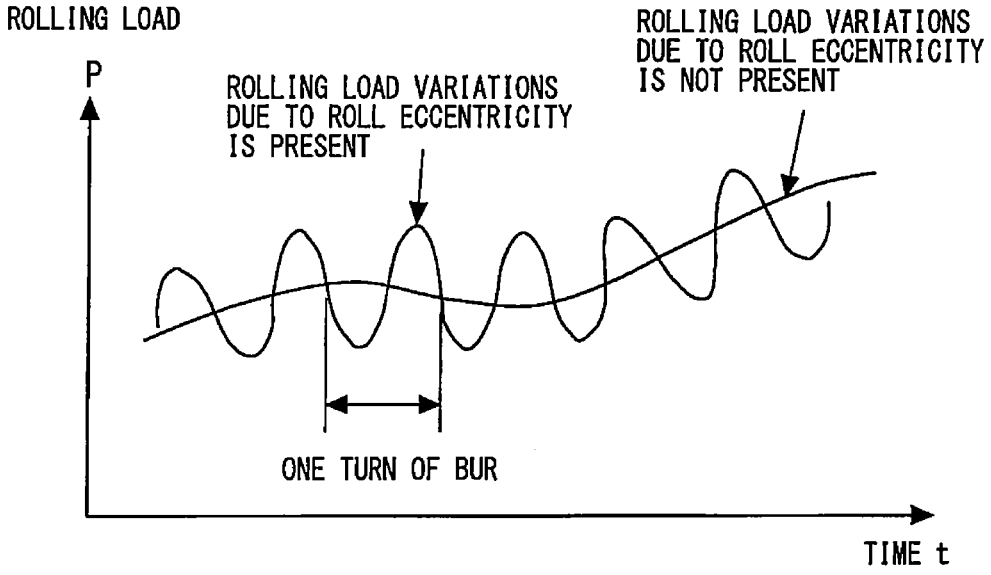
FIG. 2 is a diagram showing the concept of the rolling load to be measured.

FIG. 2 is a diagram showing the concept of the rolling load to be measured. As shown in FIG. 2, the load during the rolling of the rolled material 1 (the rolling load) varies with the lapse of time (i.e., the rotation of rolls), for example, due to changes in the temperature of the rolled material 1 and changes in plate thickness even in the case where a periodic disturbance mainly caused by the roll eccentricity of the back up roll 4 does not occur. On the other hand, for example, in the case where there is a roll eccentricity in the back up roll 4, the rolling load is expressed by a load obtained by adding variation components of rolling load due to roll eccentricity and the like to variations caused by factors other than the roll eccentricity and the like. The present invention has the basic concept that by accurately separating variation components due to roll eccentricity and the like from the rolling load, the separated variation components (i.e., rolling load variations due to roll eccentricity and the like) are controlled by this control apparatus, and rolling load variations due to factors other than roll eccentricity and the like are controlled by the above-described MMC and GM-AGC.

Figure 3:
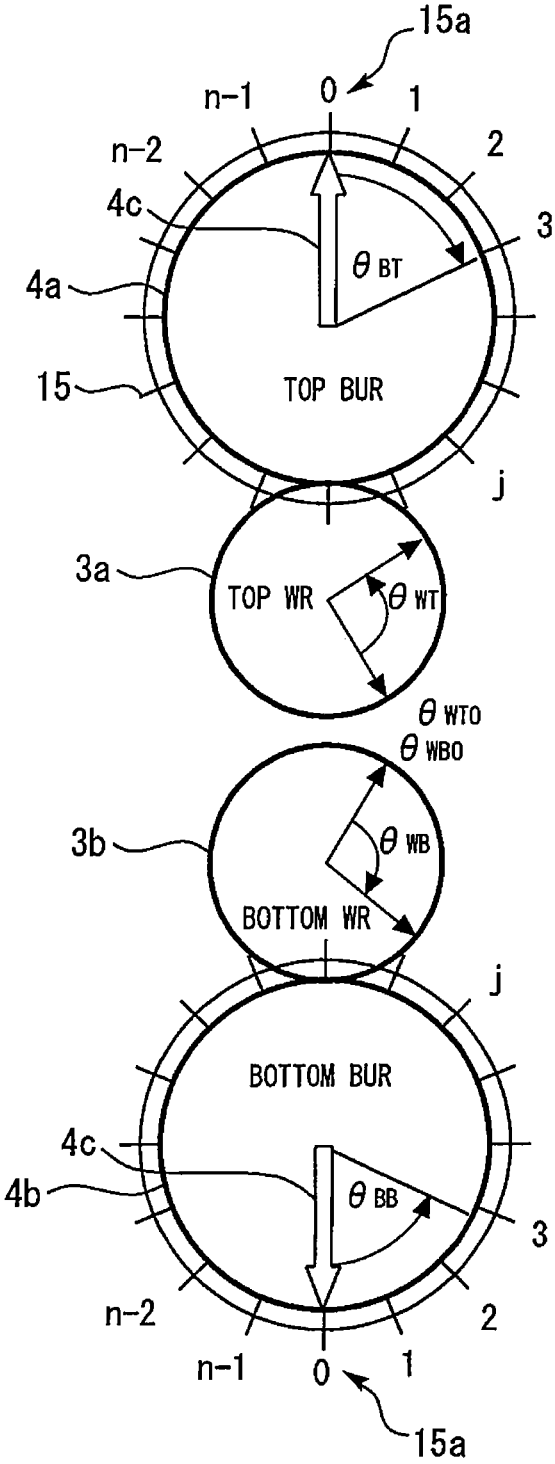
FIG. 3 is a diagram to explain a relationship between the division of a back up roll and a work roll.

FIG. 3 is a diagram to explain a relationship between the division of the back up roll and the work roll. Specifically, FIG. 3 shows the case where the whole circumference of the back up roll 4 is divided into n equal parts and a corresponding position scale mark 15 is provided on the outer side of the back up roll 4 in the vicinity thereof. The position scale mark 15 is provided to explain the function and the like of each of the means 10 to 14, and it is not always necessary that the position scale mark 15 be provided in actual devices.

The position scale mark 15 is intended for detecting the rotational position of the back up roll 4 and is provided on the housing 2 side. That is, the position scale mark 15 does not rotate with the back up roll 4. The position scale mark 15 is such that numbers up to (n−1) are assigned, with a certain position (a reference position 15*a* on the fixed side) as 0. This n is set to, for example, n=30 to 60 or so.

A reference position 4*c* on the rotation side is set beforehand on the back up roll 4. This reference position 4*c* is set in a certain position of the back up roll 4 and rotates naturally in response to the rotation of the back up roll 4.

By embedding a sensor, such as a proximity sensor, and an object to be detected, which is capable of being detected by this sensor, in the reference positions 15*a* and 4*c*, the roll reference position detector 8 can be constituted by using the sensor and the object to be detected. In this case, for example, when the proximity sensor disposed in the reference position 4*c* reaches the reference position 15*a* on the fixed side, the object to be detected, which is embedded in the reference position 15*a*, is detected by the proximity sensor. That is, it is recognized that the reference position 4*c* of the back up roll 4 has passed the reference position 15*a* on the fixed side.

Figure 4:
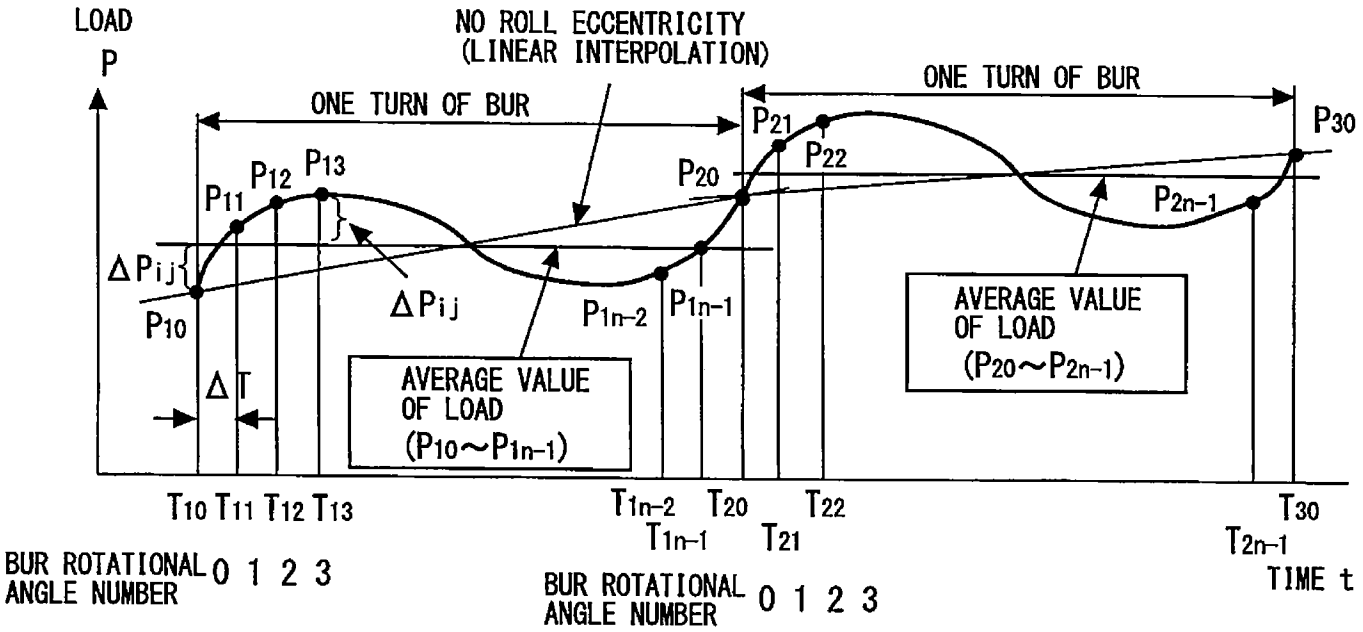
FIG. 4 is a diagram to explain an example of extracting variation components due to roll eccentricity and the like from loads.

$\theta_{WTO}$ shown in FIG. 4 is the rotational angle of the top work roll 3*a* that is obtained when the reference position 4*c* of the top back up roll 4*a* coincides with the reference position 15*a* on the fixed side, while $\theta_{WT}$ is the rotational angle of the top work roll 3*a* when the top back up roll 4*a* has rotated by $\theta_{BT}$. The same applies to the rotational angle of the bottom work roll 3*b*. The suffix T on the right side indicates the top side, and the suffix B indicates the bottom side.

In the following, the rotational angle of the back up roll 4 refers to the angle formed when the reference position 4*c* on the rotation side moves in response to the rotation of the back up roll 4 from the reference position 15*a* on the fixed side. For example, the fact that the rotational angle of the back up roll 4 is 90 degrees states that the reference position 4*c* is in a position obtained when the reference position 4*c* has rotated 90 degrees from the reference position 15*a* on the fixed side in the rotational direction of the back up roll 4. Furthermore, the condition in which the rotational angle of the back up roll 4 is at the nearest scale mark in the position scale mark 15 (for example, the j-th scale mark in the position scale mark 15) refers to the fact that the rotational angle number (corresponding to the rotational position) of the back up roll 4 is j.

FIG. 4 is a diagram to explain an example of extracting variation components due to roll eccentricity and the like from loads. In the following, the description will be given by taking the case where a detected load is a rolling load as an example.

In the case where the reference position 4*a* of the back up roll 4 coincides with the reference position 15*a* on the fixed side, that is, when the rotational angle number of the back up roll 4 is 0, the rolling load indicates $P_{10}$. When the back up roll 4 rotates and the rotational angle number thereof proceeds to 1, 2, 3 . . . , the rolling load also changes to $P_{11}$, $P_{12}$, $P_{13}$ . . . . When the back up roll 4 rotates one turn and the rotational angle number becomes from (n−1) to 0 again, the rolling load $P_{20}$ is sampled. The straight line connecting the rolling loads $P_{10}$ and $P_{20}$ can be regarded as the rolling load in which rolling load variations due to roll eccentricity and the like are removed. Therefore, variation components of rolling load due to roll eccentricity and the like can be found from differences between the rolling loads $P_{10}$, $P_{11}$, $P_{12}$, $P_{13}$ . . . $P_{20}$ which are measured at each rotational angle number and the above-described straight line.

Values of actually measured rolling load $P_{ij}$ (actual value) often include noise components in addition to rolling load variations due to temperature variation, plate thickness variation, tension variation and the like and rolling load variations due to roll eccentricity and the like. For this reason, the actual values of actual rolling load are not distributed on a gentle curve as shown in FIG. 4, and in some cases, it is difficult to identify a rolling load $P_{i0}$ which becomes a start point of the above-described straight line and a rolling load $P_{(i+1)0}$ which becomes an end point.

Therefore, it is assumed that a difference between the rolling loads $P_{i0}$ and $P_{(i+1)0}$ be not large. An average value of the measured n rolling loads $P_{i0}$, $P_{i1}$, $P_{i2}$, $P_{i3}$ . . . $P_{i(n-1)}$ is found and the difference $\Delta P_{ij}$ between each of the rolling loads $P_{i0}$, $P_{i1}$, $P_{i2}$, $P_{i3}$ . . . $P_{i(n-1)}$ and this average value is regarded as variation components of rolling load caused by the roil eccentricity and the like. The advantage of this method is that it is possible to sample actual values of rolling load up to the (n−1)-th division and that this method is robust to rolling load variations due to noise and the like. There is also effective means to reduce noise components by subjecting actual values of rolling load to filtering processing.

Figure 5:
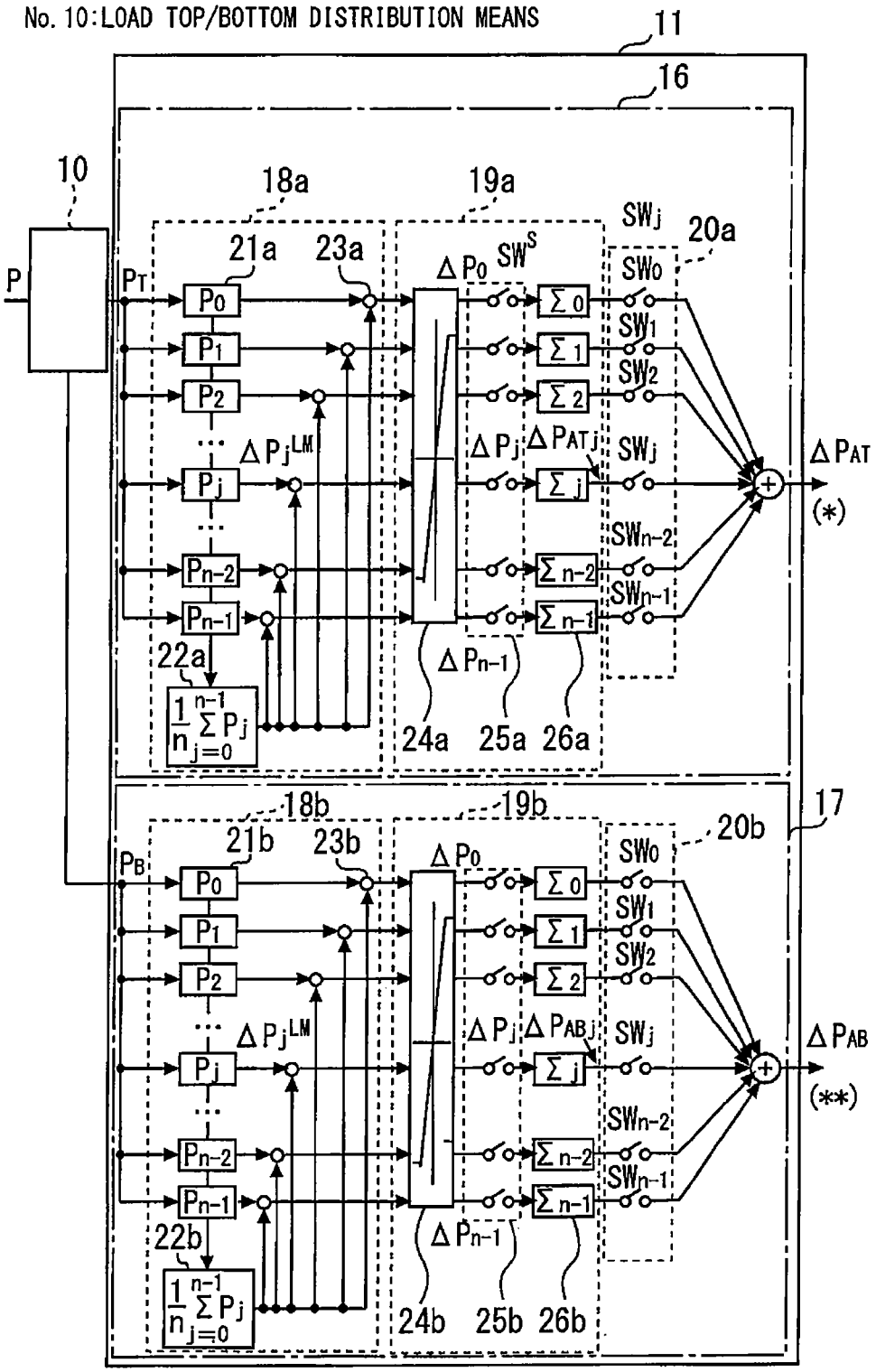
FIG. 5 is a detail view of the main part of the control apparatus of a rolling mill shown in FIG. 1.
Figure 6:
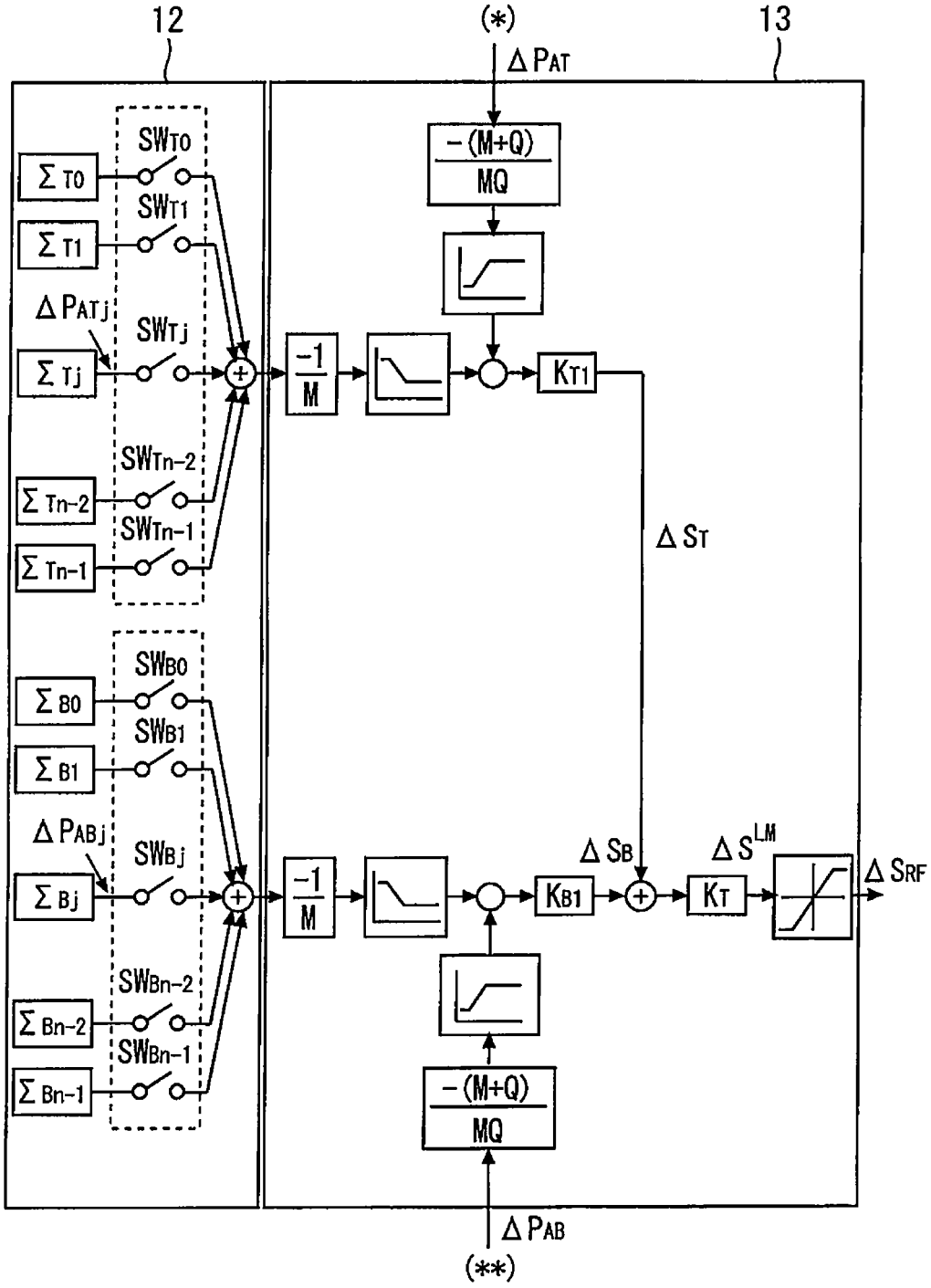
FIG. 6 is a detail view of the main part of the control apparatus of a rolling mill shown in FIG. 1.

FIGS. 5 and 6 are detail views of the main parts of the control apparatus of a rolling mill shown in FIG. 1. Specifically, FIG. 5 shows detail views of the load top/bottom distribution means 10 and the load top/bottom variation identification means 11, and FIG. 6 shows detail views of the top/bottom identified load variation storage means 12 and the manipulated variable computation means 13.

The load top/bottom distribution means 10 has the function of separating a load (for example, an actual value of rolling load) detected by the load detecting device 6 into two values. The load detecting device 6 can obtain only one value as the load for one stand. For example, a total load P which is the sum of a load detected by the load detecting device 6D and a load detected by the load detecting device 60 is inputted to the load top/bottom distribution means 10. The load top/bottom distribution means 10 assumes that this total load P detected by the load detecting device 6 be generated individually at the top back up roll 4*a* and the bottom back up roll 4*b*, and divides the total load P into a top side load $P_T$ and a bottom side load $P_B$. Specifically, the load top/bottom distribution means 10 performs the distribution of the total load P by the following expressions:

[Expression 2]

$$P_T = R \cdot P \tag{2}$$

[Expression 3]

$$P_B = (1-R) \cdot P \tag{3}$$

where, $P_T$: Load generated at the top back up roll (top side load)

$P_B$: Load generated at the bottom back up roll (bottom side load)

P: Actual value of total load (detected value by the load detecting device)

R: Ratio of the total load P to be distributed to the top side load $P_T$

The load top/bottom distribution means 10 outputs the values $P_T$ and $P_B$ which are obtained by distributing the total load P to two of the top and bottom side loads, to the load top/bottom variation identification means 11.

The load top/bottom variation identification means 11 is provided with top side load variation identification means 16 and bottom side load variation identification means 17. The top side load variation identification means 16 has the function of identifying a variation component of the top side load generated in connection with the rotational position of rolls from the top side load $P_T$ distributed by the load top/bottom distribution means 10 and the function of outputting the identification data (the top side variation component) to the manipulated variable computation means 13 at appropriate timing. The bottom side load variation identification means 17 has the function of identifying a variation component of the bottom side load generated in connection with the rotational position of rolls from the bottom side load $P_B$ distributed by the load top/bottom distribution means 10 and the function of outputting the identification data (the bottom side variation component) to the manipulated variable computation means 13 at appropriate timing.

In the following, referring to FIG. 5, a concrete description will be given of the configurations and functions of the top side load variation identification means 16 and the bottom side load variation identification means 17.

The main part of the top side load variation identification means 16 is composed of deviation computation means 18*a*, identification means 19*a*, and a switch 20*a*.

The deviation computation means 18*a* has the function of extracting a top side variation component generated in connection with the rotational position of rolls from the top side load $P_T$, which is an input value from the load top/bottom distribution means 10.

Specifically, when the top side load $P_T$ is inputted from the load top/bottom distribution means 10, the deviation computation means 18*a* records the top side load $P_T$ for each rotational angle number of the back up roll 4. For example, the deviation computation means 18*a* is provided with n (j=0, 1, 2 . . . n−1) record areas 21*a*, and as the back up roll 4 rotates, the top side load $P_T$ is sequentially recorded in a corresponding record area 21*a*. That is, the top side load $P_T$ generated when the rotational angle number of the back up roll 4 is 0 is recorded as the load $P_0$ in the record area 21*a*. Similarly, the top side load $P_T$ generated when the rotational angle number of the back up roll 4 is j is recorded as the load $P_j$ in the record area 21*a*.

The top side load $P_T$ from the load top/bottom distribution means 10 is held in the record area 21*a* while the back up roll 4 is rotating one turn. When the back up roll 4 rotates one turn and the load $P_j$ is recorded in all record areas 21*a* (for example, when the top side load $P_T$ with the rotational angle number as n−1, is recorded as the load $P_{n-1}$ in the record area 21*a*), the average value of loads recoded in each record area 21*a* is computed by average value computation means 22*a*. Furthermore, when the computation of the average value is finished, a subtractor 23*a* computes, for each rotational angle number, the difference $\Delta P_j$ between the load $P_j$ in the record area 21*a* and the average value computed by the average value computation means 22*a*.

The computation result (the above-described difference) of the subtractor 23*a* is equivalent to the deviation $\Delta P_{ij}$ shown in FIG. 4, i.e., a variation component of load caused by roll eccentricity and the like. FIG. 5 shows the configuration used when an average value is computed by the average value computation means 22*a*. However, the calculation of the deviation may be performed by finding the straight line explained in FIG. 4. In this case, the deviation computation means 18*a* makes computations using an expression of the straight line, with the load $P_0$ as a start point and the load $P_n$ as an end point, and calculates a difference between the straight line and the load $P_j$ at each rotational angle number.

The deviation $\Delta P_j$ outputted from the subtractor 23*a*, i.e., a variation component of load due to roll eccentricity and the like is inputted to the identification means 19*a* and upper and lower limits are checked by a limiter 24*a*. At the point when the check of the upper and lower limits of the deviation $\Delta P_j$ of each rotational angle number is finished, each switch 25*a* is concurrently turned on and the deviation $\Delta P_j$ is inputted to each adder 26*a* all at once. Each adder 26*a* performs the addition of the deviation $\Delta P_j$ on the basis of the following expression.

[Expression 4]

$$Z_j[k+1]=Z_j[k]+\Delta P_j \quad (4)$$

where, $Z_j$: Value of the adder $\Sigma_j$ k: Number of times of additions (in general, it is equal to the rotation speed of the back up roll)

j: 1 to n−1

Each of the adders 26*a* is cleared to zero before the rolling of the rolled material 1 is rolled. The adder 26*a* performs the addition of the deviation $\Delta P_j$ once each time the back up roll 4 rotates one turn and the computation of the average value by the average value computation means 22*a* is finished. Adding the deviation $\Delta P_j$ for each rotational angle number can be easily explained by a general control rule. That is, in the case where there is no integration system in a controlled object as in this controlled object, removing a steady-state deviation by providing an integrator on the controller side is appropriate in terms of a control rule. In the present invention, adders are used instead of integrators because the controlled object is a discrete system, not a continuous system.

The switch 20*a* constitutes means for taking out a deviation of load (i.e., identification data) added for each rotational angle of the back up roll 4 according to the rotational position of the back up roll 4. For example, at the point when the reference position 4*c* of the back up roll 4 has passed the reference position 15*a* (j=0) on the fixed side, among the switches 20*a*, only corresponding $SW_0$ becomes on, and $\Delta P_{AT0}$ is taken out of $\Sigma_0$ of the adder 26*a*. Similarly, when the reference position 4*c* has reached the rotational angle number 1, only $SW_1$ becomes on, and $\Delta P_{AT1}$ is taken out of $\Sigma_1$. Such action is performed at each rotational angle number and taking out the load variation value $\Delta P_{AT}$ is carried out repeatedly.

On the other hand, the bottom side load variation identification means 17 is provided with deviation computation means 18*b*, identification means 19*b*, and a switch 20*b*. Because the bottom side load variation identification means 17 has substantially the same function as the top side load variation identification means 16, a concrete description of each configuration is omitted. The main part of the deviation computation means 18*b* is composed of a record area 21*b*, average value computation means 22*b*, and a subtractor 23*b*. The identification means 19*b* is provided with a limiter 24*b*, a switch 25*b*, and an adder 26*b*.

The top/bottom identified load variation storage means 12 has the function of storing values (added value) of the adders 26*a* and 26*b* at a given point for each rotational angle number of the back up roll 4 and outputting the values at appropriate timing as required. The concrete configuration and function of the top/bottom identified load variation storage means 12 will be described later.

The manipulated variable computation means 13 has the function of computing a roll gap instruction value in such a manner as to reduce variation components of loads caused by roll eccentricity and the like and outputting the computation result to the roll gap manipulation means 14. Specifically, the manipulated variable computation means 13 performs the computation of the instruction value on the basis of the top and bottom side load variation values ($\Delta P_{AT}$ and $\Delta P_{AB}$) inputted from the load top/bottom variation identification means 11 and the storage contents (output values) of the top/bottom identified load variation storage means 12.

<Control after the Elapse of a Prescribed Period of Time after Start of the Rolling of the Rolled Material 1>

On the basis of the top side variation component and the bottom side variation component of the rolling load that has been identified by the load top/bottom variation identification means 11, the manipulated variable computation means 13 computes a roll gap instruction value responding to each rotational position of rolls and reduces plate thickness variations of the rolled material 1. Specifically, the manipulated variable computation means 13 computes an amount of correction of roll gap ΔS (mm) in each rotational position of rolls on the basis of the following expressions.

[Expression 5]

$$\Delta S_T = \frac{-(M+Q)}{MQ} \cdot K_{T1} \cdot \Delta P_{AT} \quad (5)$$

[Expression 6]

$$\Delta S_B = \frac{-(M+Q)}{MQ} \cdot K_{B1} \cdot \Delta P_{AB} \quad (6)$$

The roll gap cannot be manipulated individually on the top and bottom sides. For this reason, it is necessary that the manipulated variable computation means 13 outputs an instruction value for the roll gap manipulation means 14 by adding an amount of correction for the top and bottom sides.

[Expression 7]

$$\Delta S=K_T\cdot(\Delta S_T+\Delta S_B) \quad (7)$$

where,

M: Mill constant

Q: Plastic coefficient of rolled material $K_T$, $K_{T1}$, $K_{B1}$: Adjustment coefficient $\Delta S_T$: Amount of correction of roll gap for top back up roll $\Delta S_B$: Amount of correction of roll gap for bottom back up roll ΔS: Amount of correction of roll gap $\Delta P_{AT}$: Deviation of rolling load by top back up roll (output of the top side load variation identification means 16)

$\Delta P_{AB}$: Deviation of rolling load by bottom back up roll (output of the bottom side load variation identification means 17)

The manipulated variable computation means 13 outputs a computed amount of correction of roll gap ΔS (mm) to the roll gap manipulation means 14.

The roll gap is a positive value in the open direction and a negative value in the closed direction. The same applies to the following.

The amount of correction of roll gap ΔS, which is an output of the manipulated variable computation means 13, is intended for compensating for variation components of loads which are caused by roll eccentricity and the like. For this reason, the roll gap manipulation means 14 adds the amount of correction of roll gap a from the manipulated variable computation means 13 to the amount of roll gap obtained by MMC, GM-AGC or the like, and outputs the resulting amount of roll gap to the screw-down device 5, thereby appropriately manipulating the roll gap.

The roll gap manipulation means 14 is configured in such a manner as to be able to individually control a roll gap on the drive side and a roll gap on the operator side. This is because in the case where one end portion of the rolled material 1 is elongated during rolling of the rolled material 1, the rolls are moved so that the roll gap on the side of the elongated end portion becomes large to make corrections. In the case where it is unnecessary to individually control the roll gaps on the drive side and the operator side, the roll gap manipulation means 14 outputs, for example, an instruction value of the same value to the drive side screw-down device 5D and the operator side screw-down device 50.

<Control Until a Prescribed Period of Time has Elapsed after Start of the Rolling of the Rolled Material 1>

As described above, the adders 26*a* and 26*b* of the load top/bottom variation identification means 11 are cleared to zero before the rolling of the rolled material 1. During the period of the start of the rolling of the rolled material 1 until the back up roll 4 rotates one turn, in the load top/bottom variation identification means 11, identification data is not accumulated in the adders 26*a* and 26*b*, and therefore, it is impossible to output load variation values ($\Delta P_{AT}$ and $\Delta P_{AB}$). Furthermore, even after the back up roll 4 rotates one turn, immediately after the start of the rolling of the rolled material 1 (that is, until a prescribed period of time has elapsed after the start of the rolling of the rolled material 1), many noises are superposed on a detected rolling load, it is undesirable to perform gauge control using the rolling load alone.

For this reason, in this control apparatus, for the duration from the start of the rolling of the rolled material 1 until a prescribed period of time has elapsed, gauge control is performed also using identification date prepared beforehand.

In the following, a description will be given of a concrete control method which is used until the prescribed period of time has elapsed.

In this control apparatus, before the start of the rolled material 1, control is performed in such a manner that the rolls are rotated at a given speed in a kiss-roll condition, whereby loads are generated. At this time, the load top/bottom variation identification means 11 is caused to perform the same control as that during the rolling of the rolled material 1 (the above-described control explained using FIG. 5), to thereby output a top side variation component $\Delta P_{AT}$ and a bottom side variation component $\Delta P_{AB}$ of the load in a kiss-roll condition, which have been identified, to the manipulated variable computation means 13. That is, in this control, P shown in FIG. 5 becomes the load in a kiss-roll condition. On the basis of the inputted values of $\Delta P_{AT}$ and $\Delta P_{AB}$, the manipulated variable computation means 13 computes a roll gap instruction value responding to each rotational position of rolls in such a manner as to reduce variation components of the load in a kiss-roll condition occurring in connection with the rotational position of rolls, and causes the roll gap manipulation means 14 to perform the control of the screw-down device 5.

Figure 7:
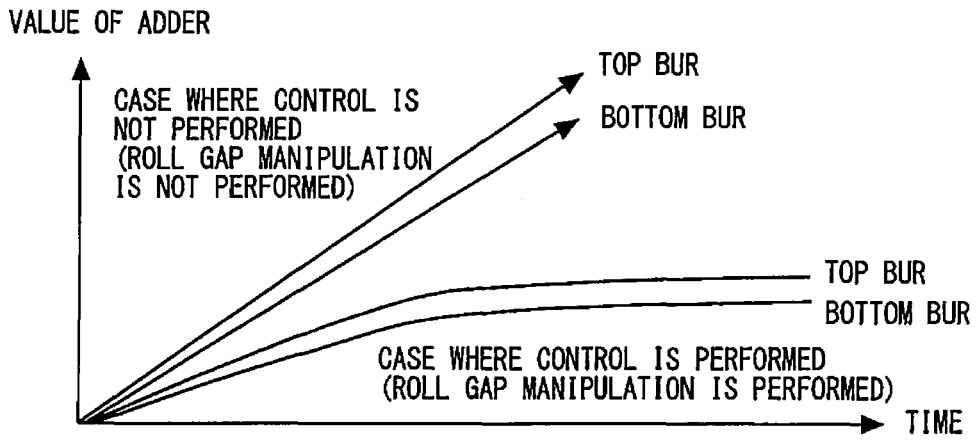
FIG. 7 is a diagram to explain a value of an adder observed when a load is caused to be generated in a kiss-roll condition.

FIG. 7 is a diagram to explain the value of the adder observed when a load is caused to be generated in a kiss-roll condition. When the rolls are caused to rotate in a kiss-roll condition, in the case where neither a computation by the manipulated variable computation means 13 nor a manipulation by the roll gap manipulation means 14 (i.e., a roll gap adjustment) is performed, a fixed value is added to the adders 26*a* and 26*b* of the load top/bottom variation identification means 11 for each rotation of the rolls. For this reason, the values of the adders 26*a* and 26*b* increase with time in an ever-increasing manner. On the other hand, in the case where the adjustment of roll gap is made, the roll gap is manipulated in such a manner as to be in proportion to the disturbance components. Therefore, the amount of increase in the added value gradually decreases and becomes a given value after the elapse of a given period of time.

This condition can be regarded as that variation components of loads caused by roll eccentricity and the like are appropriately identified in the adders 26*a* and 26*b*. For this reason, the top/bottom identified load variation storage means 12 stores, for each rotational angle number of the back up roll 4, the values of the adders 26*a* and 26*b* at this time, i.e., the top side variation component and bottom side variation component of the load in a kiss-roll condition which are identified by the load top/bottom variation identification means 11. For example, the top/bottom identified load variation storage means 12 stores, for each rotational angle number of the back up roll 4, the values of the adders 26*a* and 26*b* obtained after the elapse of a prescribed period of time after the start of the control in a kiss-roll condition. Furthermore, for example, the top/bottom identified load variation storage means 12 monitors the values of the adders 26*a* and 26*b* and stores, for each rotational angle number of the back up roll 4, the values of the adders 26*a* and 26*b* obtained when the variations of the values (for example, amounts of increase in a prescribed period of time) have fallen in a prescribed range.

Figure 8:
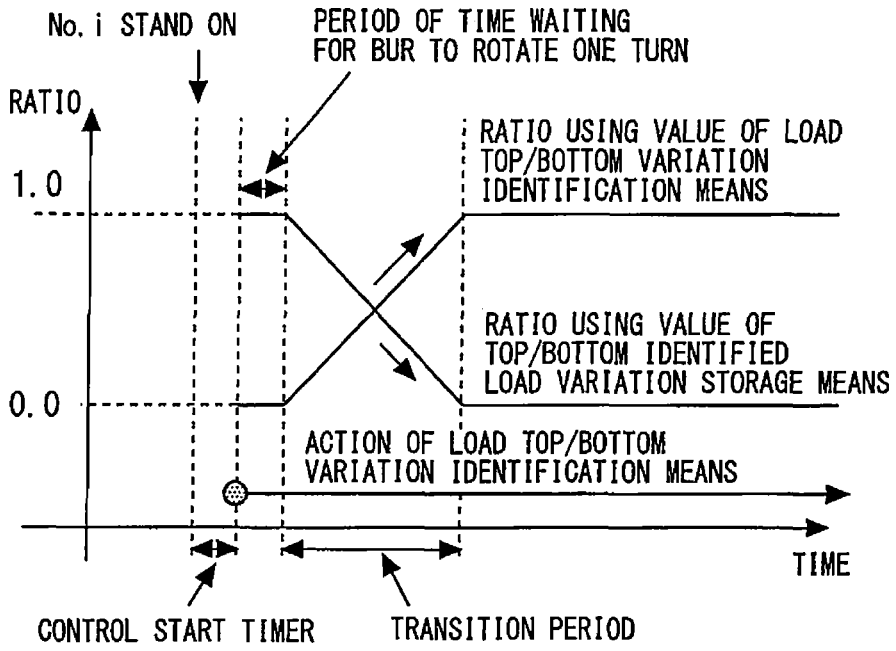
FIG. 8 is a diagram to explain the control contents of a manipulated variable computation means for the duration from the start of rolling until a prescribed transition period has elapsed.

As shown in FIG. 8, for a given period after the start of the rolling of the rolled material 1, the manipulated variable computation means 13 performs the computation of an amount of correction of roll gap ΔS (mm) also in consideration of the storage contents of the top/bottom identified load variation storage means 12. FIG. 8 is a diagram to explain the control contents of the manipulated variable computation means for the duration from the start of rolling until a prescribed transition period has elapsed.

As described above, for the duration from the start of the rolling of the rolled material 1 until the back up roll 4 rotates one turn, identification data is not accumulated in the adders 26*a* and 26*b*. For this reason, at least for the duration until the back up roll 4 rotates one turn, the manipulated variable computation means 13 performs the computation of the amount of correction ΔS (mm) using only the storage contents (i.e., the top side variation component and bottom side variation component of the load in a kiss-roll condition) of the top/bottom identified load variation storage means 12 without using the top side variation component and bottom side variation component of the rolling load which are identified by the load top/bottom variation identification means 11.

For a prescribed transition period after the start of the rolling of the rolled material 1, the manipulated variable computation means 13 performs the computation of the amount of correction ΔS (mm) using both the top side variation component and bottom side variation component of the rolling load which are identified by the load top/bottom variation identification means 11, i.e., the values of the adders 26*a* and 26*b* and the storage contents of the top/bottom identified load variation storage means 12. At this time, in the computation of the amount of correction ΔS (mm), the manipulated variable computation means 13 increases the ratio of using the top side variation component and bottom side variation component of the rolling load which are identified by the load top/bottom variation identification means 11, with the lapse of time, whereby it is ensured that the effect of an actual rolling load greatly manifests itself. In FIG. 8, although changes in the use ratio are indicated by straight lines, the changes may be indicated by quadratic curves and EXP curves.

When the transition period has elapsed, as described above, the manipulated variable computation means 13 performs the computation of the amount of correction 6S (mm) only using the top side variation component and bottom side variation component of the rolling load which are identified by the load top/bottom variation identification means 11, without using the storage contents of the top/bottom identified load variation storage means 12.

According to the control apparatus having the above-described configuration, in the gauge control during the rolling of a metal material, it is possible to appropriately reduce periodic disturbances caused by the roll eccentricity and the like. With this control apparatus, it is possible to solve also the problem in the roll eccentricity control 1 in (A) and the problem in the roll eccentricity control 2 in (B), which have been described above. Furthermore, with this control apparatus, it is possible to realize highly accurate gauge control even at an extreme leading end of the rolled material 1, making it possible to supply high-quality products.

In this embodiment, it is preferred that in the load top/bottom distribution means 10, the ratio R of the total load P to be distributed to the load $P_r$ be set at a value in the vicinity of 0.5. That is, a value close to ½ of the total load P is distributed to a load generated in the top back up roll 4*a* and a load generated in the bottom back up roll 4*b*. As a result of this, one of the top and bottom adders 26*a*, 26*b* can almost completely cancel the rolling load variation component due to roll eccentricity and the like by the counterpart of the back up roll 4*a* or 4*b*. Furthermore, it is also possible to adjust the value of R by making a comparison between the values of the adders 26*a* and 26*b* which are the results of the identification. For example, when the value of the adder 26*a* is 0.9 times the value of the adder 26*b*, it is appropriate to set R to 0.45 or so. According to the results of a test by the applicants, R is preferably in the range from not less than 0.4 to not more than 0.6.

Second Embodiment

Figure 9:
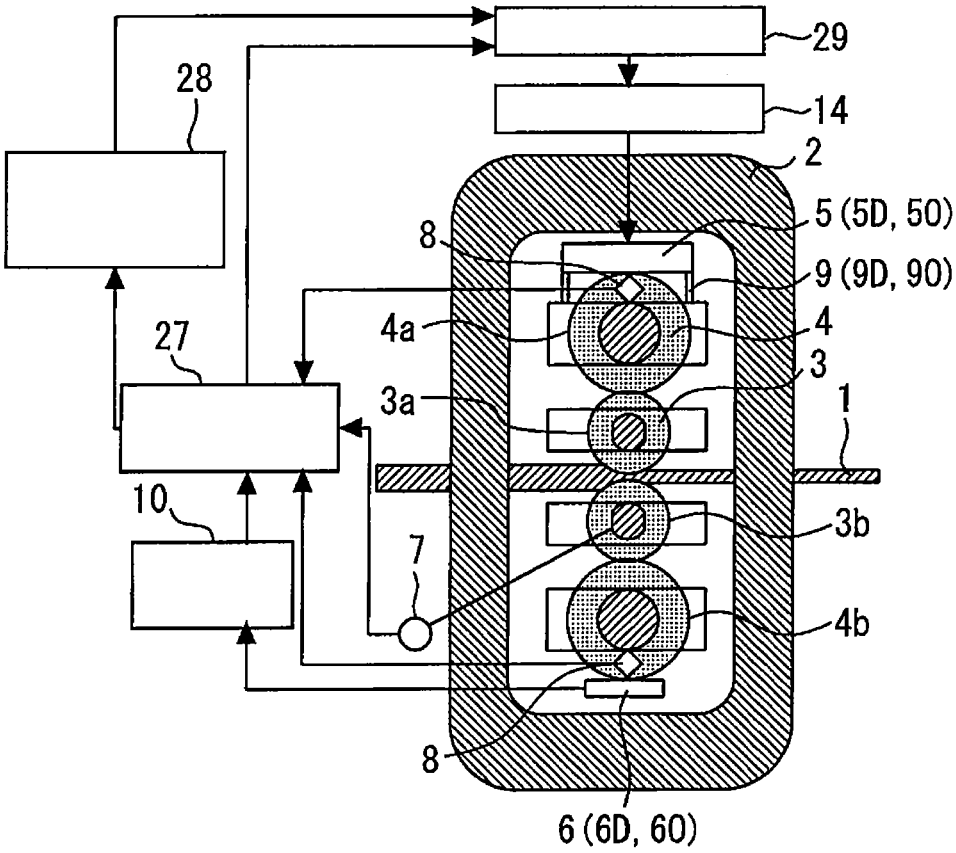
FIG. 9 is a diagram showing the general configuration of a control apparatus of a rolling mill in a second embodiment according to the present invention.

FIG. 9 is a diagram showing the general configuration of a control apparatus of a rolling mill in a second embodiment according to the present invention.

In FIG. 9, reference numeral 27 denotes roll gap top/bottom variation identification means, reference numeral 28 denotes top/bottom identified roll gap variation storage means, and reference numeral 29 denotes manipulated variable computation means.

In the first embodiment, the description was given of the case where load signals are accumulated in the adders 26*a* and 26*b* of the load top/bottom variation identification means 11. However, the rolling load sometimes shows changes in the amplitude of variations depending on the width, deformation resistance (hardness) and the like of the rolled material 1. Therefore, in this embodiment, a description will be given of the case where a load signal is converted to a value corresponding to a roll gap and then, accumulated to the adder. With this configuration, it becomes possible to retain and store a signal as a quantity which depends on the structure of a rolling mill and does not depend on the size or characteristics, such as hardness, of the rolled material 1.

Figure 10:
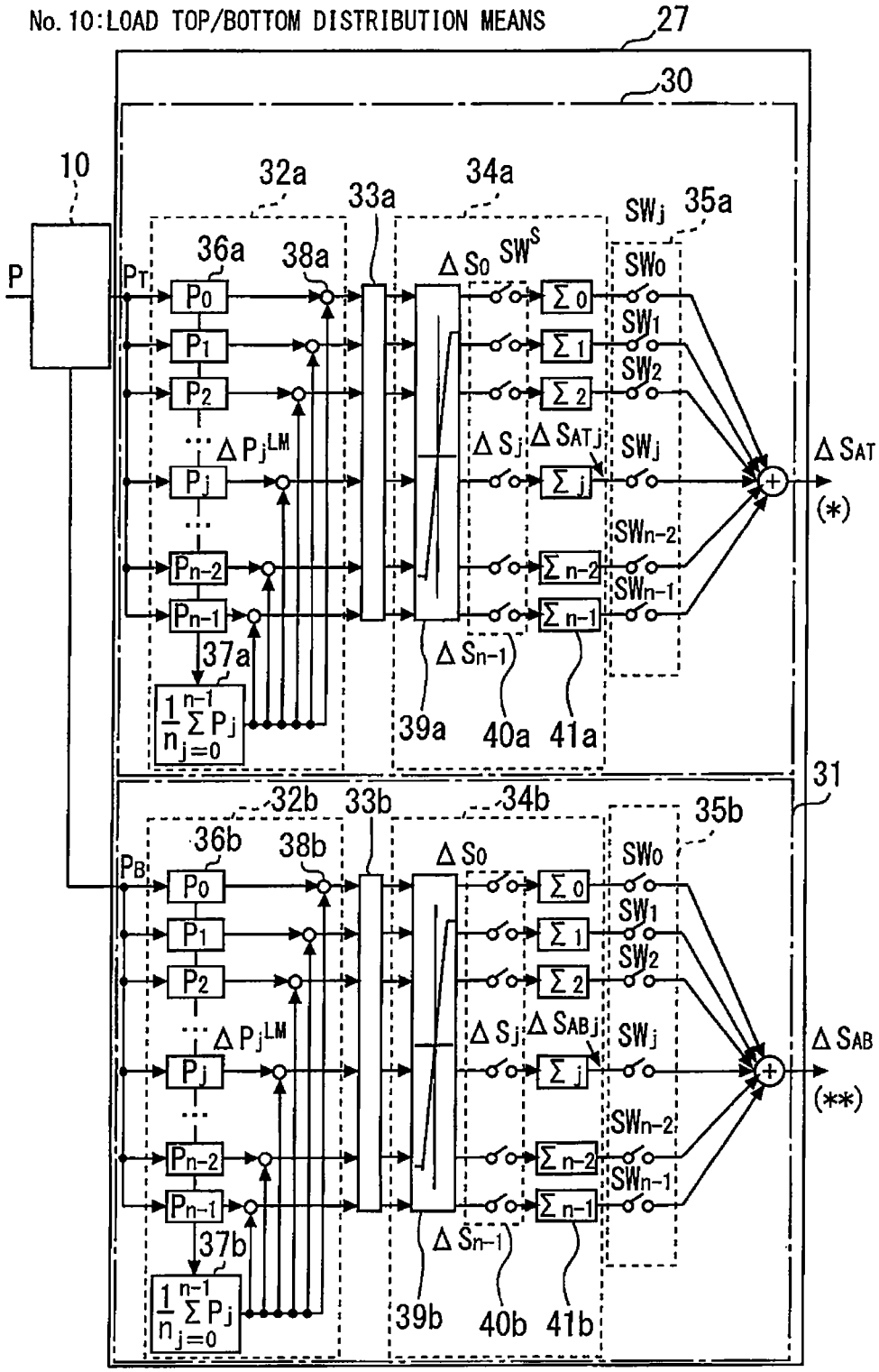
FIG. 10 is a detail view of the main part of the control apparatus of a rolling mill shown in FIG. 9.
Figure 11:
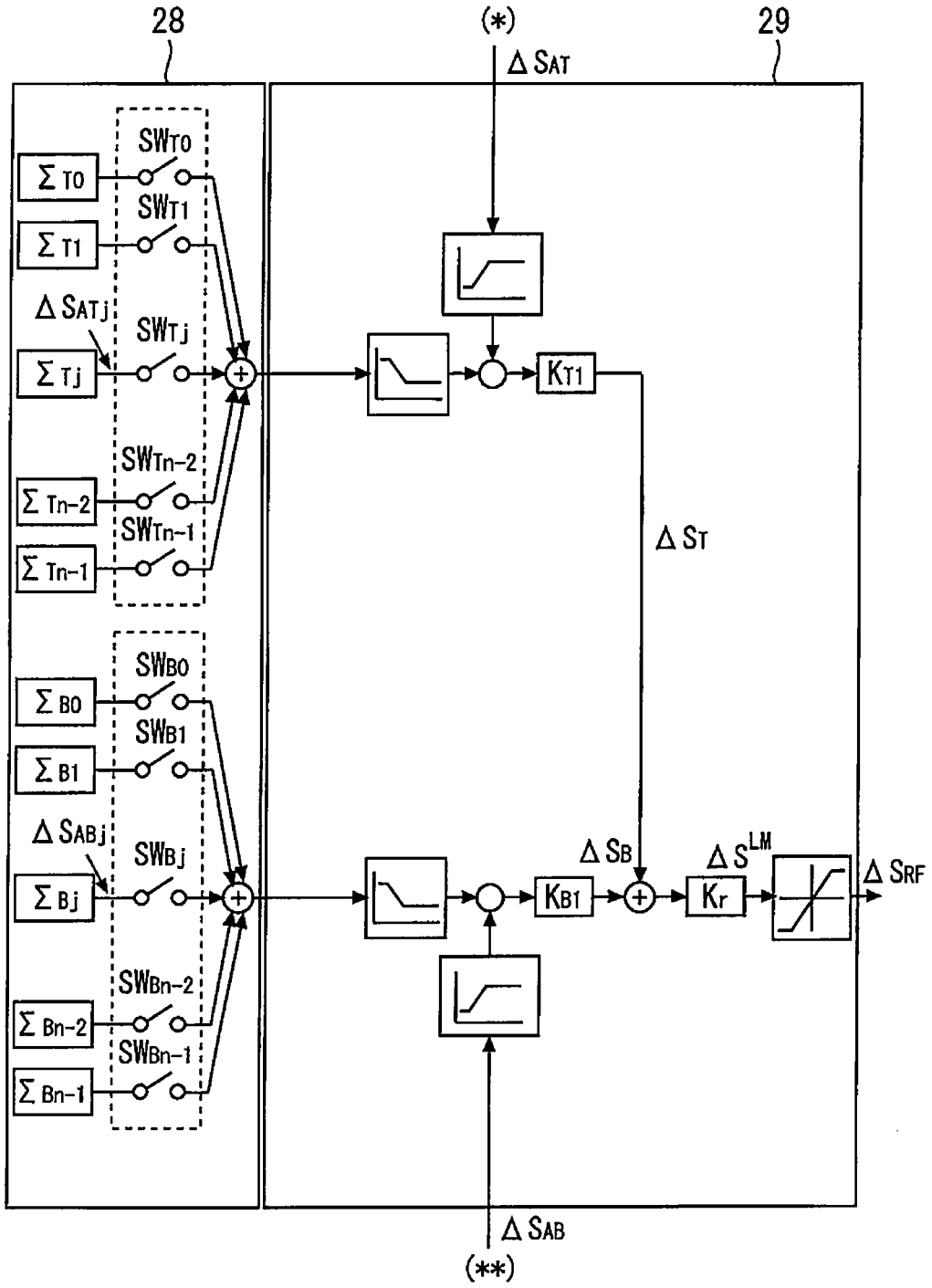
FIG. 11 is a detail view of the main part of the control apparatus of a rolling mill shown in FIG. 9.

Referring to FIGS. 10 and 11, a concrete description will be given below of the functions peculiar to this embodiment. FIGS. 10 and 11 are detail views of the main parts of the control apparatus of a rolling mill shown in FIG. 9, and show portions corresponding to FIGS. 5 and 6, respectively. Specifically, FIG. 10 shows detail views of the load top/bottom distribution means 10 and the roll gap top/bottom variation identification means 27, and FIG. 11 shows detail views of the top/bottom identified roll gap variation storage means 28 and the manipulated variable computation means 29.

The roll gap top/bottom variation identification means 27 is provided with top side roll gap variation identification means 30 and bottom side roll gap variation identification means 31. The top side roll gap variation identification means 30 has the function of identifying a roll gap variation component occurring in connection with the rotational position of rolls from the top side load $P_T$ distributed by the load top/bottom distribution means 10 and the function of outputting the identification data (the top side variation component) to the manipulated variable computation means 29 at appropriate timing. The bottom side roll gap variation identification means 31 has the function of identifying a roll gap variation component occurring in connection with the rotational position of rolls from the bottom side load $P_B$ distributed by the load top/bottom distribution means 10 and the function of outputting the identification data (the bottom side variation component) to the manipulated variable computation means 29 at appropriate timing.

Specifically, the main part of the top side roll gap variation identification means 30 is composed of deviation computation means 32*a*, conversion means 33*a*, identification means 34*a*, and a switch 35*a*. The functions of the deviation computation means 32*a*, the identification means 34*a*, and the switch 35*a* are substantially the same as the functions of the above-described deviation computation means 18*a*, identification means 19*a*, and switch 20*a*. That is, the deviation computation means 32*a* is provided with a record area 36*a*, average value computation means 37*a*, and a subtractor 38*a*. Furthermore, the identification means 34*a* is provided with a limiter 39*a*, a switch 40*a*, and an adder 41*a*.

The conversion means 33*a* has the function of converting the top side variation component of a load extracted by the deviation computation means 32*a* to the displacement of a roll gap. For example, the conversion means 33*a* is provided between the deviation computation means 32*a* and the identification means 34*a*, and converts the deviation $\Delta P_j$ outputted from the subtractor 38*a*, i.e., the variation component of the load caused by roll eccentricity and the like to a value corresponding to the roll gap on the basis of the following expression:

[Expression 8]

$$\Delta S_j = \frac{-MQ}{M+Q} \cdot \Delta P_j \tag{8}$$

The value $\Delta S_j$ converted by the conversion means 33*a* is inputted to the identification means 34*a* and upper and lower limits thereof are checked by the limiter 39*a*. Each of the switches 40*a* is simultaneously turned on at the point when the check of the upper and lower limits of the converted value $\Delta S_j$ of each rotational angle number is finished, and the converted value $\Delta S_j$ is fed to each of the adders 41*a* all at once. Each of the adders 41*a* performs the same computation as that according to Expression 4 above and adds the converted value $\Delta S_j$, i.e., the top side displacement of the roll gap.

The conversion means 33*a* may also be installed between the limiter 39*a* and the switch 40*a* or between the switch 40*a* and the adder 41*a*.

Because the bottom side roll gap variation identification means 31 has the same configuration as the top side roll gap variation identification means 30, a concrete description thereof is omitted.

Also in this embodiment, for the duration from the start of the rolling of the rolled material 1 until a prescribed period has elapsed, this control apparatus performs gauge control also using identification data prepared beforehand. For this reason, in this control apparatus, before the start of the rolling of the rolled material 1, control is performed in such a manner that the rolls are rotated at a given speed in a kiss-roll condition and a load is thereby generated. The manipulated variable computation means 29 is caused to compute a roll gap instruction value responding to each rotational position of the rolls in such a manner as to reduce the roll gap variation component occurring in connection with the rotational position of the rolls, and the roll gap manipulation means 14 is caused to control the screw-down device 5.

Because in a kiss-roll condition, it is unnecessary to consider the elastic coefficient Q of the rolled material 1, the conversion means 33*a* and 33*b* performs a conversion to a value corresponding to the roll gap on the basis of the following expression:

[Expression 9]

$$\Delta S_j = \frac{-1}{M} \cdot \Delta P_j \tag{9}$$

After the above-described control is performed in a kiss-roll condition for a prescribed period of time, the top/bottom identified roll gap variation storage means 28 stores, for each rotational position of rolls, the top side variation component and bottom side variation component of the roll gap which are identified by the roll gap top/bottom variation identification means 27, (i.e., the values of the adders 41*a* and 41*b*). After the start of the rolling of the rolled material 1, in the same manner as in the first embodiment, on the basis of the top and bottom roll gap variation values ($\Delta S_{AT}$ and $\Delta S_{AB}$) which are inputted from the roll gap top/bottom variation identification means 27, as well as the storage contents (output values) of the top/bottom identified roll gap variation storage means 28, the manipulated variable computation means 29 performs the computation of an instruction value for the roll gap manipulation means 14.

The configurations and functions not described in detail in this embodiment are the same as in the first embodiment.

Even in the control apparatus having the above-described configuration, it is possible to produce the same effect as in the first embodiment above. Furthermore, with the control apparatus of this embodiment, it is possible to store values which do not depend on the material characteristics of the rolled material 1 but depend only on the characteristics of the rolling mill in the adders 41*a* and 41*b* as well as the top/bottom identified roll gap variation storage means 28. For this reason, even in the case where the characteristics of the rolled material 1, which becomes a controlled object, change, it is possible to restrict an adverse effect on control performance to a minimum extent and it is possible to supply high-quality products.

Third Embodiment

Figure 12:
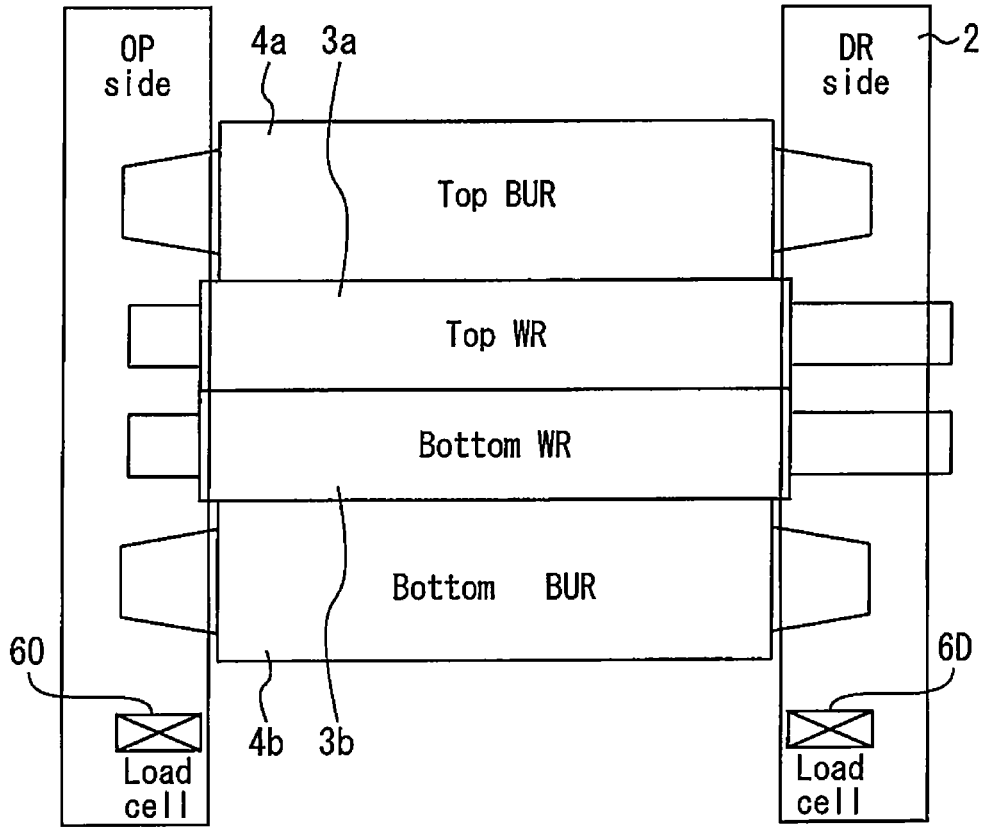
FIG. 12 is a diagram showing the rolling mill shown in FIG. 1 as viewed from the rolling direction of a rolled material.

FIG. 12 is a diagram showing the rolling mill shown in FIG. 1 as viewed from the rolling direction of a rolled material.

There are cases where roll gap variation components caused by the roll eccentricity and the like are not the same on the right and left sides of the rolled material 1, i.e., on the drive side and the operator side of the rolled material 1, for example, in the case where the construction of oil bearings used in the back up roll 4 is laterally asymmetrical. This control apparatus is provided with the screw-down device 5, the load detecting device 6, and the roll gap detector 9 on both the drive side and the operator side, and the mechanism of this control apparatus are such that a roll gap can be separately controlled on the drive side and the operator side. For this reason, in this embodiment, a description will be given of the case where on the drive side and the operator side, variation components due to periodic disturbances are separately identified and roll gap adjustments are made according to the identification data.

Because it can be considered that disturbances are caused by the same roll, the following explanation will be given on the assumption that the disturbance cycle does not change and that the amplitude is not the same on the two sides.

In this control apparatus, before the start of the rolling of the rolled material 1, control is performed in such a manner that the rolls are rotated at a given speed in a kiss-roll condition and a load is thereby generated.

Specifically, first, the rolls are rotated at a given speed in a kiss-roll condition and the load in a kiss-roll condition detected by the load detecting device 6D on the drive side is inputted to the load top/bottom distribution means 10. In this case, P shown in FIG. 5 becomes the load in a kiss-roll condition detected by the load detecting device 6D on the drive side. The load top/bottom distribution means 10 divides the load P in a kiss-roll condition detected by the load detecting device 6D into the top side load $P_T$ and the bottom side load $P_B$ which are in turn outputted to the load top/bottom variation identification means 11. Also for the distribution ratio R at this time, a value in the vicinity of 0.5 (for example, a prescribed value of not less than 0.4 but not more than 0.6) is set.

On the basis of the inputted top side load $P_T$ and bottom side load $P_B$, the load top/bottom variation identification means 11 identifies the top side variation component and bottom side variation component of the load in a kiss-roll condition, which respond to each rotational position of rolls, and outputs these variation components to the manipulated variable computation means 13 at appropriate timing. On the basis of the input values $\Delta P_{AT}$ and $\Delta P_{AB}$, the manipulated variable computation means 13 computes a roll gap instruction value responding to each rotational position of rolls in such a manner as to reduce variation components of the load in a kiss-roll condition occurring in connection with the rotational position of rolls, and causes the roll gap manipulation means 14 to control the screw-down device 5.

When a prescribed period of time has elapsed after the start of the control for roll gap adjustment and the values of the adders 26*a* and 26*b* cause not to increase (or amounts of increase fall in a prescribed range), the top/bottom identified load variation storage means 12 stores, for each rotational angle number of the back up roll 4, the values of the adders 26*a* and 26*b* at this time, i.e., the top side variation component and bottom side variation component of the load in a kiss-roll condition on the drive side which are appropriately identified by the load top/bottom variation identification means 11.

Next, the rolls are rotated in a kiss-roll condition at a given speed and the same control as described above is performed also on the operator side. As a result of this, the top side variation component and bottom side variation component of the load in a kiss-roll condition on the operator side which are identified by the load top/bottom variation identification means 11, are stored in the top/bottom identified load variation storage means 12 for each rotational angle number of the back up roll 4.

When the rolling of the rolled material 1 is started, in the same manner as in the first embodiment, the manipulated variable computation means 13 performs the computation of a roll gap instruction value $\Delta S_{RF}$ on the basis of the top and bottom load variation values ($\Delta P_{AT}$ and $\Delta P_{AB}$) inputted from the load top/bottom variation identification means 11 as well as the storage contents of the top/bottom identified load variation storage means 12. The computed instruction value $\Delta S_{RF}$ is a value for controlling the plate thickness of the rolled material 1 in the middle part of the width direction. For this reason, the manipulated variable computation means 13 further computes an instruction value on the drive side and an instruction value on the operator side from the instruction value $\Delta S_{RF}$ on the basis of the storage contents of the top/bottom identified load variation storage means 12, and outputs the computation results to the roll gap manipulation means 14.

Figure 13:
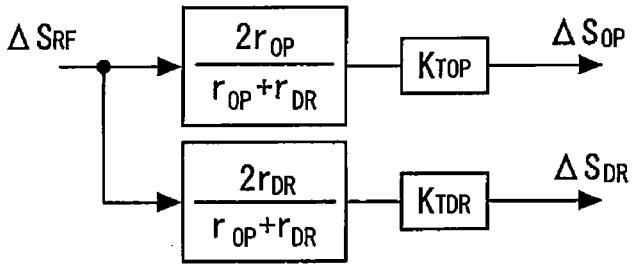
FIG. 13 is a diagram to explain a method of computing roll gap instruction values on the drive side and the operator side.

FIG. 13 is a diagram to explain a method of computing roll gap instruction values on the drive side and the operator side. As shown in FIG. 13, the manipulated variable computation means 13 performs the computation of an instruction value on the drive side and an instruction value on the operator side from the roll gap instruction value $\Delta S_{RF}$ on the basis of the following expressions:

[Expression 10]

$$\Delta S_{DR} = K_{TDR} \cdot \frac{2r_{DR}}{r_{OP} + r_{DR}} \cdot \Delta S_{RF} \tag{10}$$

[Expression 11]

$$\Delta S_{OP} = K_{TOP} \cdot \frac{2r_{OP}}{r_{OP} + r_{DR}} \cdot \Delta S_{RF} \tag{11}$$

where, $r_{DR}$: Ratio of the bottom side variation component to the top side variation component of the load in a kiss-roll condition on the drive side, both variation components being stored in the top/bottom identified load variation storage means 12

$r_{OP}$: Ratio of the bottom side variation component to the top side variation component of the load in a kiss-roll condition on the operator side, both variation components being stored in the top/bottom identified load variation storage means 12

$K_{TDR}$, $K_{TOP}$: Adjustment coefficient $\Delta S_{DR}$: Roll gap instruction value on the drive side $\Delta S_{OP}$: Roll gap instruction value on the operator side The roll gap manipulation means 14 outputs the inputted instruction value $\Delta S_{DR}$ on the drive side to the screw-down device 5D side and the instruction value $\Delta S_{OP}$ on the operator side to the screw-down device 5O side, and appropriately manipulates the roll gap on the right and left sides.

Figure 14:
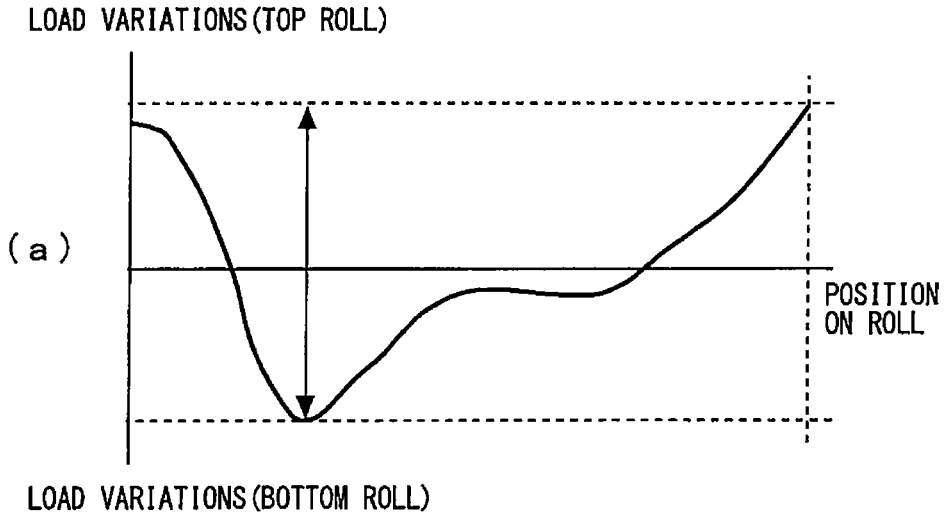
FIG. 14 is a diagram to explain methods of computing the ratios $r_{DR}$ and $r_{OP}$.
Figure 14:
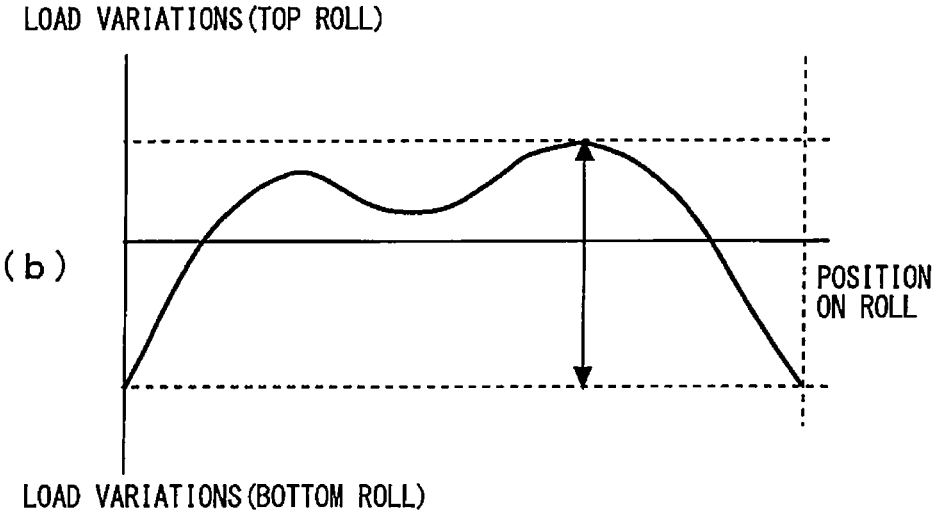
Figure 15:
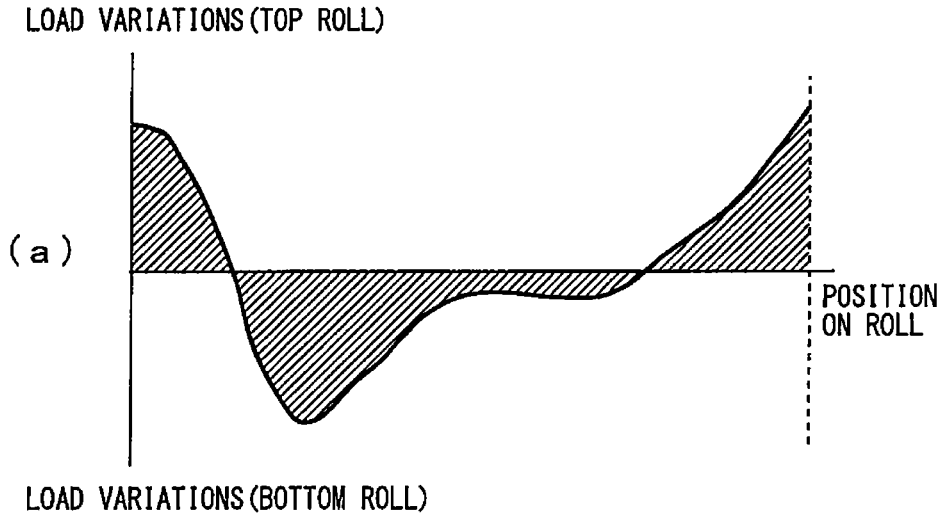
FIG. 15 is a diagram to explain methods of computing the ratios $r_{DR}$ and $r_{OP}$.
Figure 15:
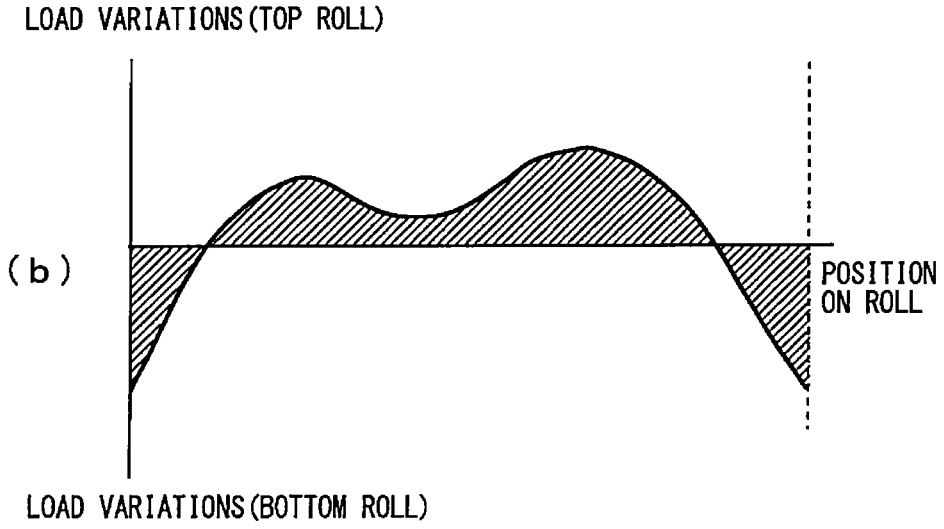

FIGS. 14 and 15 are diagrams to explain methods of computing the ratios $r_{DR}$ and $r_{OP}$. Hereinafter, a concrete description will be given of two methods of computing the ratios $r_{DR}$ and $r_{OP}$. In FIGS. 14 and 15, the ordinates indicate the variation components of the load in a kiss-roll condition which are stored in the top/bottom identified load variation storage means 12, and the abscissas indicate the rotational positions of rolls. For example, in the case where in FIG. 3, the back up roll 4 is divided into 60 parts, scale marks of 0 to 59 are given on the abscissa.

FIG. 14 shows the case where the ratios $r_{DR}$ and $r_{OP}$ are computed from the maximum value and minimum value of the variation components. In this case, the ratios $r_{DR}$ and $r_{OP}$ are indicated as the ratio of a peak value of the bottom side variation component to the peak value of the top side variation component of the load in a kiss-roll condition, both variation components being stored in the top/bottom identified load variation storage means 12. FIG. 15 shows the case where the ratios $r_{DR}$ and $r_{OP}$ are computed from the hatched areas. In this case, the ratios $r_{DR}$ and $r_{OP}$ are each expressed as the ratio of a value obtained by integrating the absolute value of the bottom side variation component, to a value obtained by integrating the absolute value of the top side variation component of the load in a kiss-roll condition, both variation components being stored in the top/bottom identified load variation storage means 12.

In the case where the ratios $r_{DR}$ and $r_{OP}$ are computed from the peak value, the processing burden can be reduced, but compared to the case where an integrated value is used, the computation is vulnerable to the effect of noise. However, in this control apparatus, values (variation components) obtained in a kiss-roll condition with a few noises are used for the computation of the ratios $r_{DR}$ and $r_{OP}$. For this reason, appropriate control can be realized even in the case where the ratios $r_{DR}$ and $r_{OP}$ are computed from peak values.

With the control apparatus having the above-described configuration, also in the case where there is a difference in amplitude between periodic disturbances on the drive side and periodic disturbances on the operator side, it is possible to appropriately adjust the roll gap to suit to each amplitude, and this makes it possible to supply high-quality products.

The above-described functions peculiar to this embodiment can also be applied to the configuration described in the second embodiment. In this case, the top side variation component and bottom side variation component of the roll gap on the drive side, which are identified by the roll gap top/bottom variation identification means 27 in a kiss-roll condition, as well as the top side variation component and bottom side variation component of the roll gap on the operator side are stored for each rotational position of rolls in the top/bottom identified roll gap variation storage means 28. During the rolling of the rolled material 1, the manipulated variable computation means 29 computes an instruction value on the drive side and an instruction value on the operator side on the basis of Expressions 10 and 11. In the case where this function is applied to the configuration of the second embodiment, the ordinates of FIGS. 14 and 15 indicate variation components of roll gap.

INDUSTRIAL APPLICABILITY

The control apparatus of a rolling mill of the present invention can be applied to the gauge control during the rolling of metal materials.

REFERENCE SIGNS LIST

1 rolled material
2 housing
3 work roll
3*a* top work roll
3*b* bottom work roll
4 back up roll
4*a* top back up roll
4*b* bottom back up roll
4*c* reference position
5 screw-down device
6 load detecting device
7 roll rotation speed detector
8 roll reference position detector
9 roll gap detector
10 load top/bottom distribution means
11 load top/bottom variation identification means
12 top/bottom identified load variation storage means
13, 29 manipulated variable computation means
14 roll gap manipulation means
15 position scale mark
15*a* reference position
16 top side load variation identification means
17 bottom side load variation identification means
18*a*, 18*b*, 32*a*, 32*b* deviation computation means
19*a*, 19*b*, 34*a*, 34*b* identification means
20*a*, 20*b*, 35*a*, 35*b* switch

21*a*, 21*b*, 36*a*, 36*b* record area
22*a*, 22*b*, 37*a*, 37*b* average value computation means
23*a*, 23*b*, 38*a*, 38*b* subtractor
24*a*, 24*b*, 39*a*, 39*b* limiter
25*a*, 25*b*, 40*a*, 40*b* switch
26*a*, 26*b*, 41*a*, 41*b* adder
27 roll gap top/bottom variation identification means
28 top/bottom identified roll gap variation storage means
30 top side roll gap variation identification means
31 bottom side roll gap variation identification means
33*a*, 33*b* conversion means

The invention claimed is:

1. A control apparatus of a rolling mill for reducing periodic disturbances which are caused mainly by roll eccentricity, in gauge control during rolling of a metal material, comprising:

a load detecting device for detecting a load in a kiss-roll condition and a rolling load;

a load top/bottom distribution device which distributes loads detected by the load detecting device as a top side load and a bottom side load at a prescribed ratio;

a load top/bottom variation identification device which identifies load variation components occurring in connection with a rotational position of rolls from the top side load and the bottom side load which are distributed by the load top/bottom distribution device;

a top/bottom identified load variation storage device which stores, for each rotational position of rolls, a top side variation component and a bottom side variation component of the load in a kiss-roll condition which are identified by the load top/bottom variation identification device;

a manipulated variable computation device which computes a roll gap instruction value responding to each rotational position of rolls on the basis of the top side variation component and the bottom side variation component of the rolling load which are identified by the load top/bottom variation identification device, as well as the top side variation component and the bottom side variation component of the load in a kiss-roll condition which are stored in the top/bottom identified load variation storage device, in such a manner as to reduce plate thickness variations of a metal material which is being rolled; and a roll gap manipulation device which manipulates a roll gap on the basis of the roll gap instruction value computed by the manipulated variable computation device, wherein before the start of the rolling of the metal material, on the basis of the top side variation component and the bottom side variation component of the load in a kiss-roll condition which are identified by the load top/bottom variation identification device, the manipulated variable computation device computes a roll gap instruction value responding to each rotational position of rolls so that variation components of the load in a kiss-roll condition occurring in connection with the rotational position of rolls decrease, and causes the roll gap manipulation device to manipulate the roll gap, wherein after the control by the manipulated variable computation device is performed in a kiss-roll condition for a prescribed period of time, the top/bottom identified load variation storage device stores, for each rotational position of rolls, the top side variation component and the bottom side variation component of the load in a kiss-roll condition which are identified by the load top/bottom variation identification device, and wherein the load top/bottom variation identification device comprises:

a deviation computation device which extracts load variation components occurring in connection with the rotational position of rolls from the top side load and the bottom side load which are distributed by the load top/bottom distribution device; and an adder which adds, for each rotational position of rolls, the top side variation component and the bottom side variation component which are extracted by the deviation computation device, and in a case where variations of a value of the adder fall in a prescribed range while the control by the manipulated variable computation device is being performed in a kiss-roll condition, the top/bottom identified load variation storage device stores the value of the adder.

2. The control apparatus of a rolling mill according to claim 1, wherein:

immediately after start of the rolling of the metal material, the manipulated variable computation device computes a roll gap instruction value without using the top side variation component and the bottom side variation component of the rolling load which are identified by the load top/bottom variation identification device;

for a prescribed transition period after the start of the rolling of the metal material, the manipulated variable computation device computes a roll gap instruction value using the top side variation component and the bottom side variation component of the rolling load which are identified by the load top/bottom variation identification device, as well as the top side variation component and the bottom side variation component of the load in a kiss-roll condition which are stored in the top/bottom identified load variation storage device, and increases, with lapse of time, a ratio of using the top side variation component and the bottom side variation component of the rolling load which are identified by the load top/bottom variation identification device; and after the lapse of the transition period, the manipulated variable computation device computes a roll gap instruction value without using the top side variation component and the bottom side variation component of the load in a kiss-roll condition which are stored in the top/bottom identified load variation storage device.

3. A control apparatus of a rolling mill for reducing periodic disturbances which are caused mainly by roll eccentricity, in gauge control during rolling of a metal material, comprising:

a load detecting device for detecting a load in a kiss-roll condition and a rolling load;

a load top/bottom distribution device which distributes loads detected by the load detecting device as a top side load and a bottom side load at a prescribed ratio;

a load top/bottom variation identification device which identifies load variation components occurring in connection with a rotational position of rolls from the top side load and the bottom side load which are distributed by the load top/bottom distribution device;

a top/bottom identified load variation storage device which stores, for each rotational position of rolls, a top side variation component and a bottom side variation component of the load in a kiss-roll condition which are identified by the load top/bottom variation identification device;

a manipulated variable computation device which computes a roll gap instruction value responding to each rotational position of rolls on the basis of the top side variation component and the bottom side variation component of the rolling load which are identified by the load top/bottom variation identification device, as well as the top side variation component and the bottom side variation component of the load in a kiss-roll condition which are stored in the top/bottom identified load variation storage device, in such a manner as to reduce plate thickness variations of a metal material which is being rolled; and a roll gap manipulation device which manipulates a roll gap on the basis of the roll gap instruction value computed by the manipulated variable computation device; the load detecting device comprises a drive side load detecting device installed on the drive side of the rolling mill and an operator side load detecting device installed on the operator side of the rolling mill, wherein before start of the rolling of the metal material, the load top/bottom variation identification device identifies a top side variation component and a bottom side variation component, on the drive side, of the load in a kiss-roll condition occurring in connection with the rotational position of rolls on the basis of the load in a kiss-roll condition which is detected by the drive side load detecting device, and identifies a top side variation component and a bottom side variation component, on the operator side, of the load in a kiss-roll condition occurring in connection with the rotational position of rolls on the basis of the load in a kiss-roll condition which is detected by the operator side load detecting device;

the top/bottom identified load variation storage device stores, for each rotational position of rolls, the top side variation component and the bottom side variation component, on the drive side, of the load in a kiss-roll condition which are identified by the load top/bottom variation identification device, as well as the top side variation component and the bottom side variation component, on the operator side, of the load in a kiss-roll condition which are identified by the load top/bottom variation identification device; and during the rolling of the metal material, on the basis of the top side variation component and the bottom side variation component, on the drive side, of the load in a kiss-roll condition which are stored in the top/bottom identified load variation storage device, as well as the top side variation component and the bottom side variation component, on the operator side, of the load in a kiss-roll condition which are stored in the top/bottom identified load variation storage device, the manipulated variable computation device further computes a drive side instruction value and an operator side instruction value from the computed roll gap instruction value.

4. The control apparatus of a rolling mill according to claim 3, wherein in a case where a ratio of the bottom side variation component to the top side variation component on the drive side which are stored in the top/bottom identified load variation storage device or the top/bottom identified roll gap variation storage device, is denoted by $r_{DR}$ and a ratio of the bottom side variation component to the top side variation component on the operator side is denoted by $r_{OP}$, the manipulated variable computation device calculates a value obtained by multiplying a computed roll gap instruction value by $2\,r_{DR}/(r_{DR}+r_{OP})$ as an instruction value on the drive side and a value obtained by multiplying a computed roll gap instruction value by $2\,r_{OP}/(r_{DR}+r_{OP})$ as an instruction value on the operator side.

5. The control apparatus of a rolling mill according to claim 4, wherein:

the ratio $r_{DR}$ is determined by a peak value of the top side variation component and a peak value of the bottom side variation component on the drive side which are stored in the top/bottom identified load variation storage device or the top/bottom identified roll gap variation storage device; and the ratio $r_{OP}$ is determined by a peak value of the top side variation component and a peak value of the bottom side variation component on the operator side which are stored in the top/bottom identified load variation storage device of the top-bottom identified roll gap variation storage device.

6. The control apparatus of a rolling mill according to claim 4, wherein:

the ratio $r_{DR}$ is determined on the basis of a value obtained by adding up absolute values of the top side variation component and a value obtained by adding up absolute values of the bottom side variation component on the drive side which are stored in the top/bottom identified load variation storage device or the top/bottom identified roll gap variation storage device; and the ratio $r_{OP}$ is determined on the basis of a value obtained by adding up absolute values of the top side variation component and a value obtained by adding up absolute values of the bottom side variation component on the operator side which are stored in the top/bottom identified load variation storage device of the top-bottom identified roll gap variation storage device.

7. The control apparatus of a rolling mill according to claim 3, wherein in a case where the load detected by the load detecting device is denoted by P, the top side load is denoted by $P_T$, and the bottom side load is denoted by $P_B$, the load P is distributed so that $P_T=RP$ and $P_B=(1-R)P$ is satisfied, and R is set to a prescribed value of not less than 0.4 but not more than 0.6.

8. A control apparatus of a rolling mill for reducing periodic disturbances which are caused mainly by roll eccentricity, in gauge control during rolling of a metal material, comprising:

a load detecting device for detecting a load in a kiss-roll condition and a rolling load;

a load top/bottom distribution device which distributes loads detected by the load detecting device as a top side load and a bottom side load at a prescribed ratio;

a roll gap top/bottom variation identification device which identifies roll gap variation components occurring in connection with a rotational position of rolls from the top side load and the bottom side load which are distributed by the load top/bottom distribution device;

a top/bottom identified roll gap variation storage device which stores, for each rotational position of rolls, a top side variation component and a bottom side variation component of a roll gap which are identified by the roll gap top/bottom variation identification device in a kiss-roll condition;

a manipulated variable computation device which computes a roll gap instruction value responding to each rotational position of rolls on the basis of the top side variation component and the bottom side variation component of the roll gap which are identified by the roll gap top/bottom variation identification device during the rolling of the metal material, as well as the top side variation component and the bottom side variation component of the roll gap which are stored in the top/bottom identified roll gap variation storage device, in such a manner as to reduce plate thickness variations of the metal material which is being rolled; and a roll gap manipulation device which manipulates a roll gap on the basis of the roll gap instruction value computed by the manipulated variable computation device, wherein while rolls are rotating in a kiss-roll condition before the start of the rolling of the metal material, on the basis of the top side variation component and the bottom side variation component of the roll gap which are identified by the roll gap top/bottom variation identification device, the manipulated variable computation device computes a roll gap instruction value responding to each rotational position of rolls so that variation components of the roll gap occurring in connection with the rotational position of the rolls decrease, and causes the roll gap manipulation device to manipulate the roll gap; and after the control by the manipulated variable computation device is performed in a kiss-roll condition for a prescribed period of time, the top/bottom identified roll gap variation storage device stores, for each rotational position of rolls, the top side variation component and the bottom side variation component of the roll gap which are identified by the roll gap top/bottom variation identification device, wherein the roll gap top/bottom variation identification device comprises:

a deviation computation device which extracts variation components occurring in connection with the rotational position of rolls from the top side load and the bottom side load which are distributed by the load top/bottom distribution device;

a conversion device which converts the top side variation component and the bottom side variation component of loads extracted by the deviation computation device to a displacement of a roll gap respectively; and an adder which adds, for each rotational position of rolls, the top side displacement and the bottom side displacement of the roll gap which are converted by the conversion device, and in a case where variations of a value of the adder fall in a prescribed range while the control by the manipulated variable computation device is being performed in a kiss-roll condition, the top/bottom identified roll gap variation storage device stores the value of the adder.

9. The control apparatus of a rolling mill according to claim 8, wherein:

immediately after start of the rolling of the metal material, the manipulated variable computation device computes a roll gap instruction value without using the top side variation component and the bottom side variation component of the roll gap which are identified by the roll gap top/bottom variation identification device;

for a prescribed transition period after the start of the rolling of the metal material, the manipulated variable computation device computes a roll gap instruction value using the top side variation component and the bottom side variation component of the roll gap which are identified by the roll gap top/bottom variation identification device, as well as the top side variation component and the bottom side variation component of the roll gap which are stored in the top/bottom identified roll gap variation storage device, and increases, with lapse of time, a ratio of using the top side variation component and the bottom side variation component of the roll gap which are identified by the roll gap top/bottom variation identification device; and after the lapse of the transition period, the manipulated variable computation device computes a roll gap instruction value without using the top side variation component and the bottom side variation component of the roll gap which are stored in the top/bottom identified roll gap variation storage device.

10. A control apparatus of a rolling mill for reducing periodic disturbances which are caused mainly by roll eccentricity, in gauge control during rolling of a metal material, comprising:

a load detecting device for detecting a load in a kiss-roll condition and a rolling load;

a load top/bottom distribution device which distributes loads detected by the load detecting device as a top side load and a bottom side load at a prescribed ratio;

a roll gap top/bottom variation identification device which identifies roll gap variation components occurring in connection with a rotational position of rolls from the top side load and the bottom side load which are distributed by the load top/bottom distribution device;

a top/bottom identified roll gap variation storage device which stores, for each rotational position of rolls, a top side variation component and a bottom side variation component of a roll gap which are identified by the roll gap top/bottom variation identification device in a kiss-roll condition;

a manipulated variable computation device which computes a roll gap instruction value responding to each rotational position of rolls on the basis of the top side variation component and the bottom side variation component of the roll gap which are identified by the roll gap top/bottom variation identification device during the rolling of the metal material, as well as the top side variation component and the bottom side variation component of the roll gap which are stored in the top/bottom identified roll gap variation storage device, in such a manner as to reduce plate thickness variations of the metal material which is being rolled; and a roll gap manipulation device which manipulates a roll gap on the basis of the roll gap instruction value computed by the manipulated variable computation device, wherein the load detecting device comprises a drive side load detecting device installed on the drive side of the rolling mill and an operator side load detecting device installed on the operator side;

before start of the rolling of the metal material, the roll gap top/bottom variation identification device identifies a top side variation component and a bottom side variation component, on the drive side, of the roll gap occurring in connection with the rotational position of rolls on the basis of the load in a kiss-roll condition which is detected by the drive side load detecting device, and identifies a top side variation component and a bottom side variation component, on the operator side, of the roll gap occurring in connection with the rotational position of rolls on the basis of the load in a kiss-roll condition which is detected by the operator side load detecting device;

the top/bottom identified roll gap variation storage device stores, for each rotational position of rolls, the top side variation component and the bottom side variation component, on the drive side, of the roll gap which are identified in a kiss-roll condition by the roll gap top/bottom variation identification device, as well as the top side variation component and the bottom side variation component, on the operator side, of the roll gap which are identified in a kiss-roll condition by the roll gap top/bottom variation identification device; and during the rolling of the metal material, on the basis of the top side variation component and the bottom side variation component, on the drive side, of the roll gap which are stored in the top/bottom identified roll gap variation storage device, as well as the top side variation component and the bottom side variation component, on the operator side, of the roll gap which are stored in the top/bottom identified roll gap variation storage device, the manipulated variable computation device further computes a drive side instruction value and an operator side instruction value from the computed roll gap instruction value.

11. The control apparatus of a rolling mill according to claim 10, wherein in a case where a ratio of the bottom side variation component to the top side variation component on the drive side which are stored in the top/bottom identified load variation storage device or the top/bottom identified roll gap variation storage device, is denoted by $r_{DR}$ and a ratio of the bottom side variation component to the top side variation component on the operator side is denoted by rep, the manipulated variable computation device calculates a value obtained by multiplying a computed roll gap instruction value by $2\ r_{DR}/(r_{DR}+r_{OP})$ as an instruction value on the drive side and a value obtained by multiplying a computed roll gap instruction value by $2\ r_{OP}/(r_{DR}+r_{OP})$ as an instruction value on the operator side.

12. The control apparatus of a rolling mill according to claim 11, wherein:

the ratio $r_{DR}$ is determined by a peak value of the top side variation component and a peak value of the bottom side variation component on the drive side which are stored in the top/bottom identified load variation storage device or the top/bottom identified roll gap variation storage device; and the ratio $r_{OP}$ is determined by a peak value of the top side variation component and a peak value of the bottom side variation component on the operator side which are stored in the top/bottom identified load variation storage device or the top/bottom identified roll gap variation storage device.

13. The control apparatus of a rolling mill according to claim 11, wherein:

the ratio $r_{DR}$ is determined on the basis of a value obtained by adding up absolute values of the top side variation component and a value obtained by adding up absolute values of the bottom side variation component on the drive side which are stored in the top/bottom identified load variation storage device or the top/bottom identified roll gap variation storage device; and the ratio $r_{OP}$ is determined on the basis of a value obtained by adding up absolute values of the top side variation component and a value obtained by adding up absolute values of the bottom side variation component on the operator side which are stored in the top/bottom identified load variation storage device or the top/bottom identified roll gap variation storage device.

* * * * *